US010991334B2

(12) United States Patent
Huang et al.

(10) Patent No.: US 10,991,334 B2
(45) Date of Patent: Apr. 27, 2021

(54) DISPLAY WITH WIRELESS DATA DRIVING AND METHOD FOR MAKING SAME

(71) Applicant: A.U. VISTA, INC., Irvine, CA (US)

(72) Inventors: Yu Sheng Huang, Hsin-Chu (TW); Cheng Nan Yeh, Hsin-Chu (TW)

(73) Assignee: A.U. VISTA, INC., Irvine, CA (US)

( * ) Notice: Subject to any disclaimer, the term of this patent is extended or adjusted under 35 U.S.C. 154(b) by 0 days.

(21) Appl. No.: 16/711,735

(22) Filed: Dec. 12, 2019

(65) Prior Publication Data

US 2020/0193930 A1 Jun. 18, 2020

Related U.S. Application Data

(63) Continuation of application No. 15/488,669, filed on Apr. 17, 2017, now Pat. No. 10,553,173.

(51) Int. Cl.
*G09G 3/36* (2006.01)

(52) U.S. Cl.
CPC ..... *G09G 3/3688* (2013.01); *G09G 3/3677* (2013.01); *G09G 2300/0408* (2013.01);
(Continued)

(58) Field of Classification Search
CPC ..... E04C 2/30; E04C 2/46; E04C 2/00; E04C 2002/001; E04C 2/38; E04C 2/36;
(Continued)

(56) References Cited

U.S. PATENT DOCUMENTS 7,336,270 B2 2/2008 Sato
7,463,226 B2 12/2008 Wakita
(Continued)

FOREIGN PATENT DOCUMENTS

CN 202093783 U 12/2011
CN 103646613 A 3/2014
(Continued)

OTHER PUBLICATIONS

Taiwan Office Action, Taiwan Patent Application No. 107111931, dated Dec. 18, 2018, 7 pages.
(Continued)

*Primary Examiner* — Patrick F Marinelli
(74) *Attorney, Agent, or Firm* — Ware, Fressola, Maguire & Barber LLP

(57) ABSTRACT

A large-panel liquid crystal display uses wireless data transmission to provide display data to the pixels arranged in a two-dimensional array of pixel rows and pixel columns in the display area. Pixels are also arranged into pixel groups with each group having a plurality of pixel blocks. Antennas arranged in a two-dimensional array are used to receive wireless signals indicative of the display data from a wireless signal source and to provide display data to the pixels. Each antenna is connected to a different data line in a pixel group for providing display data to the pixel group. Antennas are embedded in the electronic layers on upper surface of the lower substrate and the wireless signal source is embedded in the backlight unit of the display. With wireless data transmission, data lines can be confined within the display area and not connected to conventional semiconductor data drivers.

19 Claims, 18 Drawing Sheets

(52) U.S. Cl.
CPC ..... *G09G 2300/0439* (2013.01); *G09G 2300/0809* (2013.01); *G09G 2300/0861* (2013.01); *G09G 2310/0278* (2013.01); *G09G 2310/08* (2013.01); *G09G 2370/16* (2013.01)

(58) Field of Classification Search
CPC ... E04C 2/246; E04B 1/02; E04B 1/61; E04B 1/6162; E04B 5/02; E04B 2001/6195; F16B 5/0036; F16B 5/0084; B32B 3/10; B32B 3/08; B32B 21/08; B32B 21/14; B32B 15/10; B32B 3/06; Y10T 403/42; Y10T 403/55; Y10T 403/44; Y10T 2001/6195; G09G 3/36–3696; G09G 2300/08–0895; G09G 2370/16
See application file for complete search history.

(56) References Cited

U.S. PATENT DOCUMENTS 7,532,187 B2 * 5/2009 Afentakis ..... G09G 3/20 345/82
7,746,335 B2 6/2010 Hsu
8,411,059 B2 4/2013 Chen et al.
9,466,018 B2 * 10/2016 Park ..... G06K 7/10198
9,620,065 B2 * 4/2017 Gilbert ..... G09G 3/3406
9,852,691 B2 * 12/2017 Hyun ..... H02J 5/005
10,741,127 B2 * 8/2020 Huang ..... H01Q 1/44
10,803,805 B2 * 10/2020 Cho ..... G09G 3/2003
2006/0066512 A1 * 3/2006 Afentakis ..... G09G 3/20 345/55
2006/0103800 A1 * 5/2006 Li ..... G02F 1/1393 349/129
2006/0160515 A1 * 7/2006 Wong ..... G01S 13/756 455/280
2007/0211007 A1 * 9/2007 Su ..... G09G 3/3648 345/92
2010/0079416 A1 * 4/2010 Chung ..... G09G 3/2085 345/204
2010/0102933 A1 * 4/2010 Hsieh ..... G06K 7/0008 340/10.2
2010/0127875 A1 * 5/2010 Wong ..... G06Q 10/08 340/572.7
2011/0298778 A1 * 12/2011 Chiang ..... G09G 3/3648 345/212
2012/0068984 A1 * 3/2012 Chen ..... G06F 3/0412 345/211
2012/0218246 A1 * 8/2012 Ueda ..... G09G 3/3618 345/211
2012/0235979 A1 * 9/2012 Shibazaki ..... G09G 3/3648 345/212
2013/0082345 A1 4/2013 Corcos et al.
2014/0253613 A1 * 9/2014 Gilbert ..... G06F 3/0412 345/697
2015/0098024 A1 * 4/2015 Nairn ..... H04N 9/3141 348/759
2015/0123765 A1 * 5/2015 Foster ..... G05B 19/048 340/5.61
2016/0189818 A1 * 6/2016 Liu ..... A61B 6/06 378/147
2017/0069243 A1 * 3/2017 Guo ..... G09G 3/2085
2018/0053795 A1 * 2/2018 Lan ..... H01L 27/124
2018/0190182 A1 * 7/2018 Li ..... G09G 3/22
2018/0220540 A1 * 8/2018 Suzuki ..... H01Q 7/00
2018/0233082 A1 * 8/2018 Wang ..... G09G 3/3258
2018/0300002 A1 * 10/2018 Cooke ..... G02F 1/17
2018/0301106 A1 * 10/2018 Huang ..... G09G 3/3688
2019/0250470 A1 * 8/2019 Huang ..... G02F 1/133602
2020/0020288 A1 * 1/2020 Huang ..... H01L 25/167
2020/0020751 A1 * 1/2020 Cho ..... H01Q 1/24

FOREIGN PATENT DOCUMENTS

CN 106710509 A 5/2017
JP 200592106 A 4/2005

OTHER PUBLICATIONS

Chinese Office Action, Chinese Patent Application No. 201810316818.2, dated Nov. 18, 2020, 7 pages.
Chinese Office Action, Chinese Patent Application No. 201810316818.2, dated Mar. 30, 2020, 9 pages.

* cited by examiner

DISPLAY WITH WIRELESS DATA DRIVING AND METHOD FOR MAKING SAME

CROSS-REFERENCE TO RELATED APPLICATION

This application is a continuation of U.S. application Ser. No. 15/488,669 filed on Apr. 17, 2017, the entire content of which is hereby incorporated by reference.

TECHNICAL FIELD

The present invention relates generally to a display panel and, more specifically, to a high-definition and high-resolution liquid crystal display.

BACKGROUND

A liquid crystal display (LCD) has a large number of pixels arranged in a two-dimensional array of rows and columns. In general, an LCD panel has one or more gate drivers to provide gate-line signals to each of the rows through a plurality of gate-lines, and one or more data or source drivers to provide signals indicative of display data to each of the columns. In a color display panel, an image is generally presented in three colors: red (R), green (G) and blue (B) and each pixel has three color sub-pixels. In some color display panel, a pixel may also have a white (W) sub-pixel.

As the number of pixels increases, data driving has become a constraint to the resolution of a large-panel TV. Currently, a high-definition large-panel TV can have a resolution of 8K or 7680×4320 pixels. The next generation of the high-definition large-panel TVs may have a 16K resolution or 15360×8640 pixels. Using the conventional LCD driving method to drive a 16K display panel, the pixel charging time may not be sufficient, especially when amorphous silicon (a-Si) or Indium Gallium Zinc Oxide (IGZO) transistors are used for switching. Meanwhile, other type of displays such as OLED displays also faces the similar technical issues.

The present invention provides a solution to the charging time problem in a high-resolution display. In particular, the present invention uses the half-source driving (HSD) configuration as disclosed, for example, in Hsu, U.S. Pat. No. 7,746,335, which is assigned to AU Optronics Corp, the parent company of the assignee of the present invention and is hereby incorporated by reference in its entirety.

SUMMARY OF THE INVENTION

The present invention uses a wireless data driving scheme to provide display data to the pixels in a large panel liquid crystal display. In the display area, pixels are arranged in a two-dimensional array of pixel rows and pixel columns. Pixels are also arranged into pixel groups with each group having a plurality of pixel blocks. Antennas arranged in a two-dimensional array are used to receive wireless signals indicative of display data from a wireless signal source and to provide the display data to the pixels. Antennas are embedded in the electronic layers on the upper surface of the lower substrate and the wireless signal source is embedded in the backlight unit of the display. With wireless data transmission, data lines can be confined within the display area and not connected to conventional semiconductor data drivers.

Thus, the first aspect of the present invention is a display panel, comprising:

a display area and a plurality of pixels arranged in a two-dimensional array of pixel rows and pixel columns in the display area; and a plurality of antennas arranged in a two-dimensional antenna array configured to provide electronic signals indicative of display data to the pixels.

According to an embodiment of the present invention, the antennas are configured to receive wireless signals indicative of the display data from a wireless signal source, and the wireless signals comprise alternate-current amplitude-modulated signals.

According to an embodiment of the present invention, the antennas are configured to receive wireless signals indicative of the display data from a wireless signal source, and the wireless signals comprise frequency signals such that the frequency signals received by each antenna are different in frequency from the frequency signals received by an adjacent antenna.

According to an embodiment of the present invention, the plurality of pixels are arranged in a plurality of pixel groups, and the two-dimensional antenna array comprises a plurality of antenna units arranged in a two dimensional array of antenna rows and antenna columns in the display area in relationship to the pixel rows and pixel columns, each of the antenna units configured to provide the electronic signals to a different pixel group.

According to an embodiment of the present invention, each of the antenna units comprises N antennas and each of the pixel groups comprises N pixel blocks, each antenna disposed in relationship to a different one of the pixel blocks, each of the pixel groups further comprising N data lines, each antenna electrically connected to a difference one of the N data lines, with N being a positive integer greater than 2.

According to an embodiment of the present invention, each pixel comprises a plurality of color sub-pixels, and the color sub-pixels in a pixel group are arranged in a plurality of sub-pixel columns in a sequential manner such that each of the N antennas is configured to provide the display data to two adjacent sub-pixel columns, and wherein the display panel further comprises a plurality of gate lines configured to provide timing signals indicative of scanning timing data to the pixel rows in the pixel group, and the gate lines are arranged in pairs such that each pair of gate lines is configured to provide the scanning timing data to a different pixel row in the pixel group.

According to an embodiment of the present invention, each sub-pixel comprises an inductance element responsive to the electronic signals, the inductive element electrically connected to a data line to provide the display data for the sub-pixel.

According to an embodiment of the present invention, the pair of gate lines comprises a first gate line and a second gate line, and the sub-pixel comprises a storage capacitor, a rectifier, a first switching element and a second switching element electrically connected to the data line in series, wherein the first switching element is configured to receive the display data from the data line through the rectifier, the first switching element further configured to provide a charge to the storage capacitor indicative of the display data in accordance with the timing signals on the first gate line, and the second switching element is configured to remove the charge from the storage capacitor in accordance with the timing signals on the second gate line.

According to an embodiment of the present invention, the two adjacent sub-pixel columns in a pixel row comprises a first sub-pixel, a second sub-pixel, a dual-gate transistor and an inductance element responsive to the electronic signals, the inductive element electrically connected to a data line to provide the display data for the first sub-pixel and the second sub-pixel through the dual-gate transistor.

According to an embodiment of the present invention, the pair of gate lines comprises a first gate line and a second gate line, wherein the first sub-pixel comprises a first storage capacitor and a first switching element electrically connected to the data line, the first switching element configured to admit a first charge to the first storage capacitor indicative of the display data in accordance with the timing signals from the first gate line, and the second sub-pixel comprises a second storage capacitor and a first switching element electrically connected to the data line, the first switching element configured to admit a first charge to the first storage capacitor indicative of the display data in accordance with the timing signals from the second gate line, wherein the dual-gate transistor is operable in a first state as a rectifier and in a second state as a shorted path, and wherein the pixel row further comprises a third gate line carrying a time signal configured to cause the dual-gate transistor to change from the first state to the second state so as to remove the first charge from the first storage capacitor and to remove the second charge from the second storage capacitor.

According to an embodiment of the present invention, the data lines in each pixel group are arranged in a first direction and the gate lines in each pixel block are arranged in a different second direction, and wherein the antenna comprises an antenna coil having a plurality of adjoining coil segments disposed in a space between two adjacent gate lines or in a space between two adjacent gate lines.

According to an embodiment of the present invention, the display panel further comprises:

a substrate, and the pixels comprise switching elements disposed on the substrate; and one or more gate drivers electrically connected to the gate lines for providing the timing signals indicative of scanning timing data, and wherein the gate drivers are disposed on the substrate as a gate driver-on-array.

According to an embodiment of the present invention, the pixels comprise switching elements and capacitors, and the display panel further comprises:

a substrate, and a plurality of component layers configured to form the switching elements and the capacitors in the pixels, wherein the component layers comprise:

a first electrically conductive layer disposed on part of the substrate, a first insulating layer disposed on the first electrically conductive layer and the substrate, a second electrically conductive layer disposed on part of the first insulating layer, a second insulating layer disposed on the second electrically conductive layer and the first insulating layer, a third electrically conductive layer disposed on part of the second insulating layer and electrically connected to the second electrically conductive layer through a via in the second insulating layer, a third insulating layer disposed on the third electrically conductive layer and the second insulating layer, a fourth electrically conductive layer disposed on part of the third insulating layer, a fourth insulating layer disposed on the fourth electrically conductive layer and the third insulating layer, and a transparent conductive layer disposed on the fourth insulating layer and electrically connected to the third electrically conductive layer through a via in the third and fourth insulating layers, wherein parts of the second electrically conductive layer, the second insulating layer and the third electrically conductive layer are arranged to form the switching elements, and parts of the first, second, third, and fourth electrically conductive layer together with parts of the first, second and third insulating layers are arranged to form the capacitors, and wherein different parts of the first electrically conductive layer are arranged to form the antennas.

According to an embodiment of the present invention, each pixel has a pixel pitch determining a height of a pixel row, and wherein each antenna unit is associated with a different pixel group, each pixel group comprising a plurality of data lines connected to the plurality of antennas in the antenna unit, and wherein the plurality of antenna units in an antenna column comprises a first antenna unit and an adjacent second antenna unit, wherein each of the data lines in the pixel group associated with the first antenna unit has a corresponding one of the data lines in the pixel group associated second antenna unit separated by a gap, wherein the gap is smaller the pixel pitch.

According to an embodiment of the present invention, the display panel further comprises a substrate, and the pixels comprise switching elements disposed on the substrate; and one or more gate drivers electrically connected to the gate lines for providing the timing signals indicative of scanning timing data, wherein the substrate has a shorter dimension and a longer dimension, and wherein the gate lines are arranged along the shorter dimension.

According to an embodiment of the present invention, the display panel further comprises a substrate, and the pixels comprise switching elements disposed on the substrate; and one or more gate drivers electrically connected to the gate lines for providing the timing signals indicative of scanning timing data, wherein the substrate has a shorter dimension and a longer dimension, and wherein the gate lines are arranged along the longer dimension.

According to an embodiment of the present invention, the display panel further comprises a substrate, a plurality of gate lines and one or more gate drivers, wherein the one or more gate drivers is electrically connected to the gate lines for providing timing signals indicative of scanning timing data to the pixels, and the substrate has a shorter dimension and a longer dimension, and wherein the gate lines are arranged along the shorter dimension.

According to an embodiment of the present invention, each of the pixels comprise a first sub-pixel and a second sub-pixel, the first sub-pixel and the second sub-pixel are connected to one of the plurality of antennas through one of data lines to receive the electronic signals indicative of display data, and each of the first sub-pixel and the second sub-pixel comprises a storage capacitor, a rectifier, a first switching element and a second switching element electrically connected to said data line in series, wherein the first switching element is configured to receive the display data from said data line through the rectifier, the first switching element further configured to provide a charge to the storage capacitor indicative of the display data in accordance with timing signals on the first gate line, and the second switching element is configured to remove the charge from the storage capacitor.

According to an embodiment of the present invention, each of the pixels comprise a first sub-pixel and a second sub-pixel, the first sub-pixel and the second sub-pixel are connected to one of the plurality of antennas through one of data lines and a dual-gate transistor to receive the electronic signals indicative of display data, and each of the first sub-pixel and the second sub-pixel comprises a storage capacitor and a first switching element, wherein the dual-gate transistor is operable in a first state as a rectifier and in a second state as a shorted path and each of the storage capacitor is electrically connected to the dual-gate transistor through the first switching element.

The second aspect of the present invention is a method for providing display data to a display panel, comprising:

arranging a plurality of pixels in a two-dimensional array of pixel rows and pixel columns in a display area in the display panel;

arranging a plurality of antennas in a two-dimensional antenna array in the display area to provide electronic signals indicative of display data to the pixels, and arranging a wireless signal source in relationship to the display panel for providing wireless signals indicative of the display data to the antennas, the wireless signals comprising alternate-current amplitude-modulated signals.

The present invention will become apparent upon reading the description taken in conjunction with FIGS. 1-19.

DETAILED DESCRIPTION

A liquid crystal display (LCD) panel uses a layer of liquid crystal molecules as a light valve, together with two polarizers, to control the transmission of light. The LCD panel has a display area and a large number of switching elements and other electronic components to define pixels for displaying image data in the display area. Pixels are arranged in a two-dimensional array of rows and columns. In a color display panel, each pixel is further divided into color sub-pixels. To form a color image on the display, data signals indicative of image or display data are provided to each column of pixels or sub-pixels, and timing signals indicative of scanning timing data are provided to each row of pixels or sub-pixels. In general, an LCD panel has one or more gate drivers to provide timing signals through a plurality of gate-lines. As the number of pixels increases, data driving has become a constraint to the resolution of a large-panel TV.

The present invention uses a wireless data driving scheme to provide display data to the pixels or sub-pixels. In some embodiments of the present invention, wireless signals indicative of display date are transmitted by a wireless signal source and received by a plurality of antennas. It should be understood that while only LCD panels are described herein as examples, the use of wireless signals to provide display data to the pixels can also be applied to other types of display panels such as organic light-emitting diode (OLED) displays and other displays to be developed in the future. Furthermore, the scope of the present invention is not limited to the specific embodiments described herein.

Figure 1:
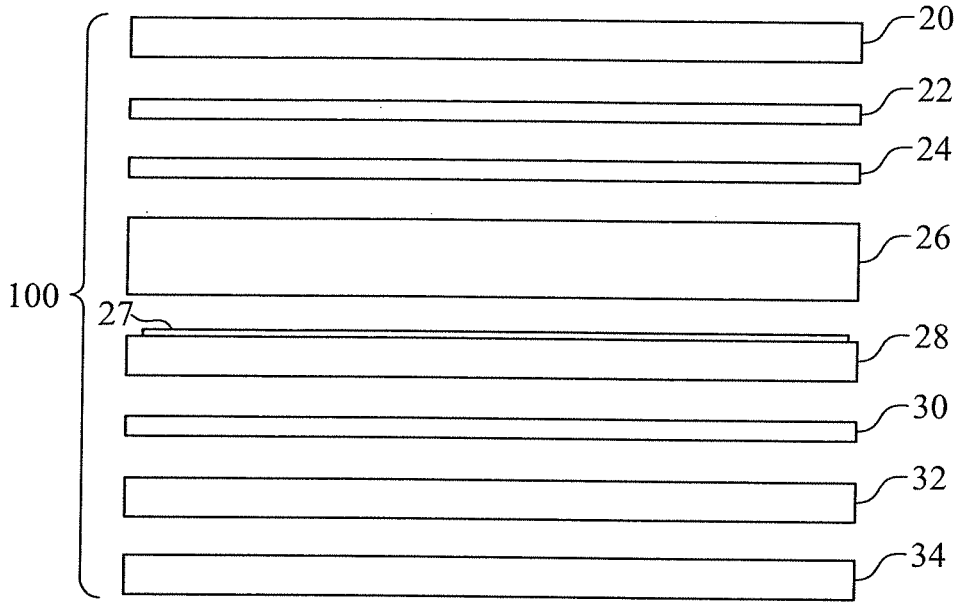
FIG. 1 shows a display panel of the present invention presented in layers.

FIG. 1 shows a display panel of the present invention presented in layers. As seen in FIG. 1, display panel 100 has eight layers: an upper substrate 20, an upper polarizer 22, a color filter layer 24, a liquid crystal layer 26, a lower substrate 28 having an electronic layer 27 disposed thereon, a lower polarizer 30, a diffuser or a light-guide plate 32 and a backlight unit 34 having a transmitter circuit embedded therein. It should be noted that the upper substrate 20, the upper polarizer 22, the color filter layer 24, the liquid crystal layer 26, the lower polarizer 30, the diffuser or light-guide plate 32 are known in the art and not part of the present invention.

According to some embodiments of the present invention, a transmitter circuit embedded in the backlight unit 34 is used as a wireless signal source to transmit wireless signals, and a plurality of antennas embedded in the electronic layer 27 on the lower substrate 28 are used to receive the wireless signals. The received wireless signals by each antenna are presented as frequency signals indicative of display data to a block of pixels or color sub-pixels. According to some embodiments of the present invention, an inductance element responsive to the frequency signals is used to receive the display data in each color sub-pixel.

Figure 2:
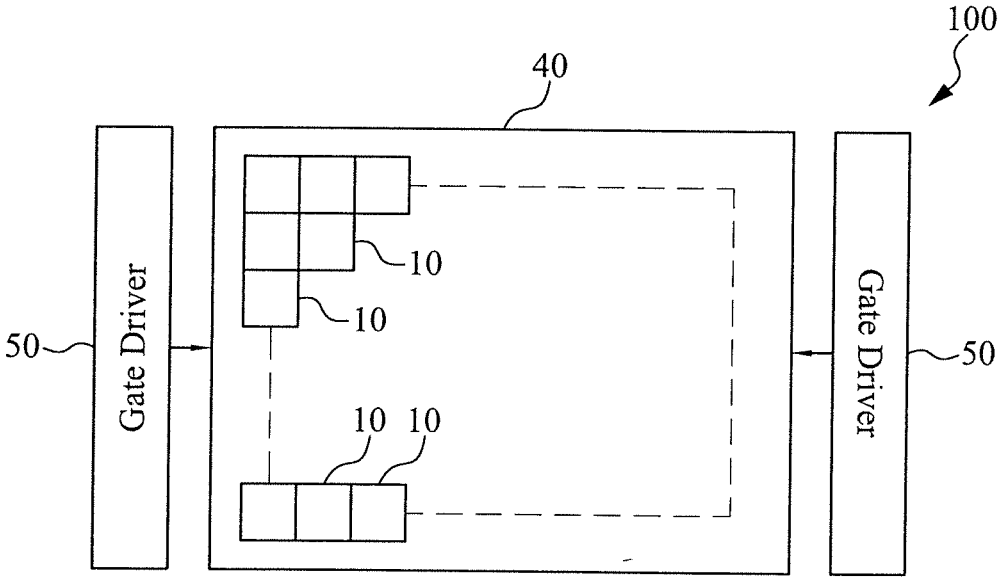
FIG. 2 shows the display area of the display panel having a plurality of pixels arranged in a two-dimensional array and one or more gate drivers to provide scanning timing data to the display area.
Figure 3:
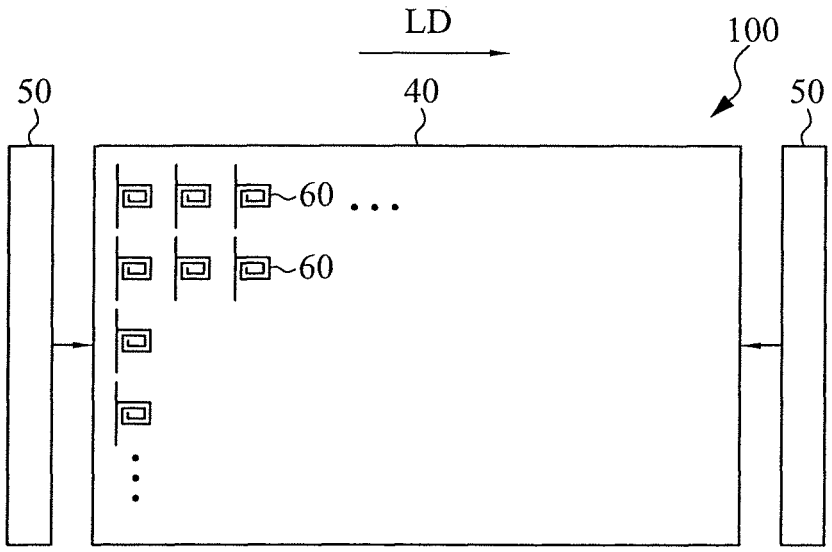
FIG. 3 shows the display area having a plurality of antenna units configured to provide display data to the display area, according to some embodiments of the present invention.
Figures 4, 4A:
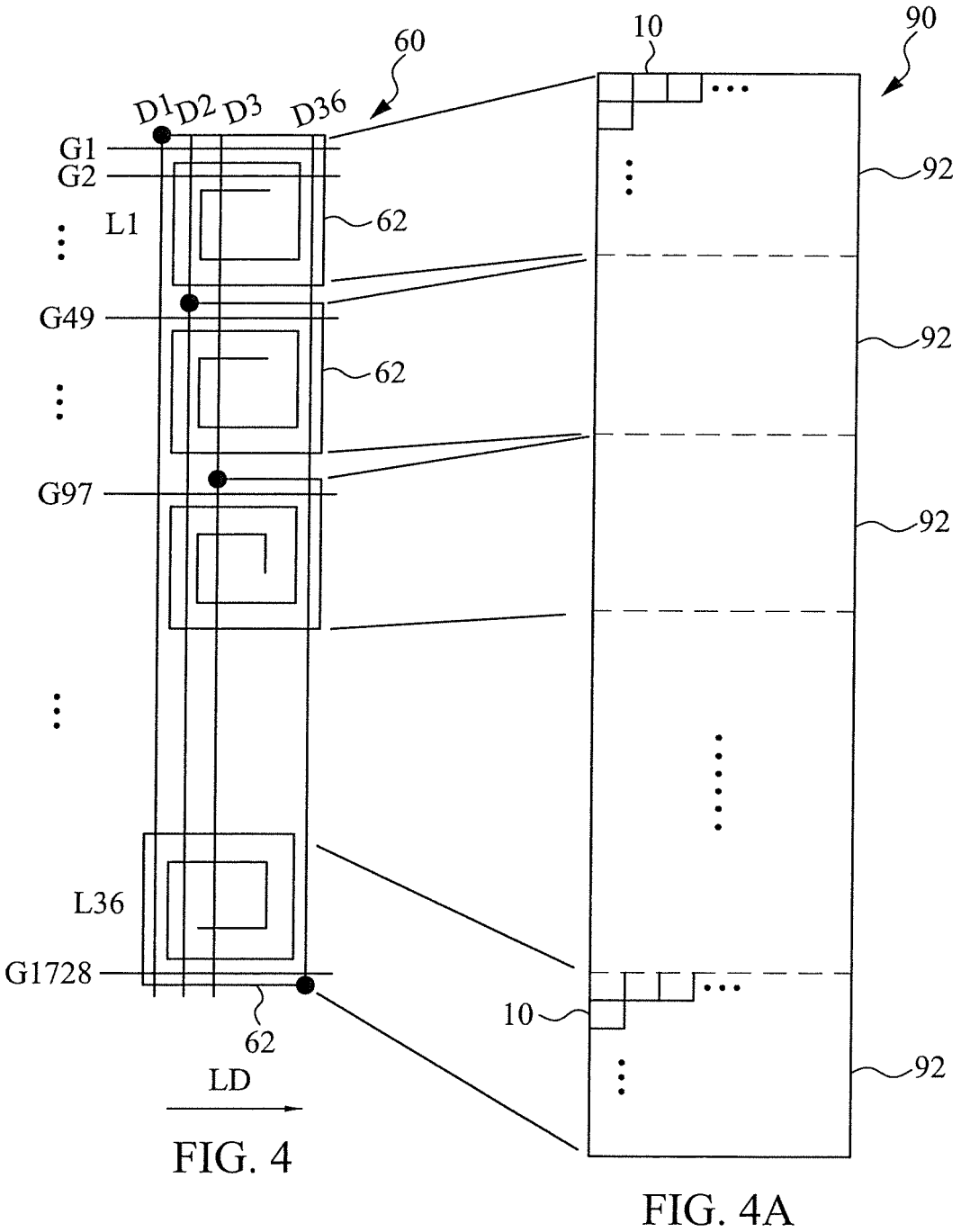
FIG. 4 illustrates an antenna unit having a plurality of antennas, according to some embodiments of the present invention.
FIG. 4A illustrates a pixel group having a plurality of pixel blocks, according to some embodiments of the present invention.
Figure 4B:
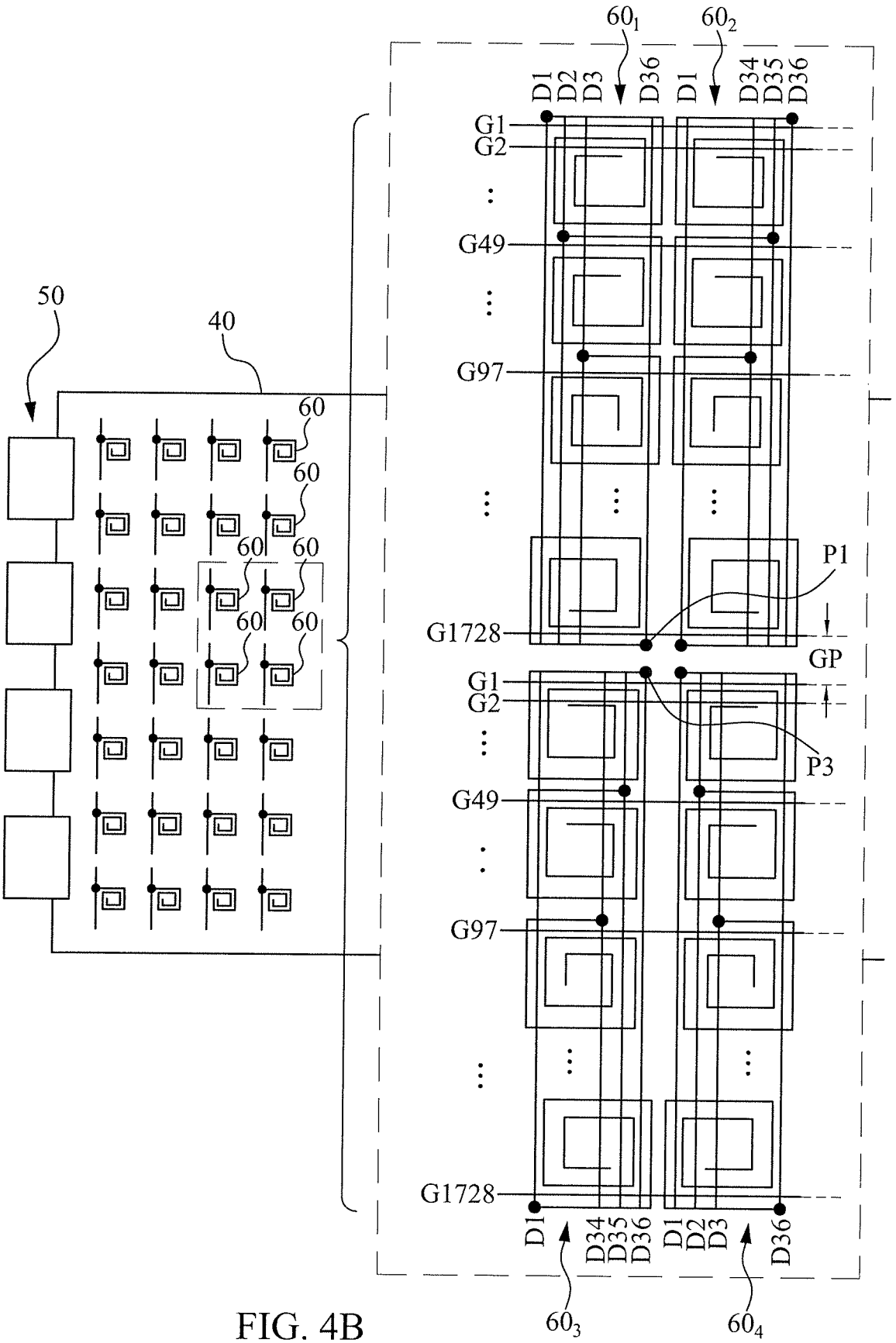
FIG. 4B illustrates the arrangement of four antenna units in four neighboring pixel groups.
Figure 5A:
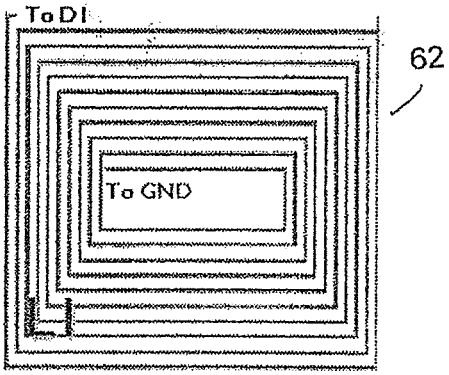
FIGS. 5A-5C illustrate three of the antennas in an antenna unit, according to some embodiments of the present invention.
Figure 5B:
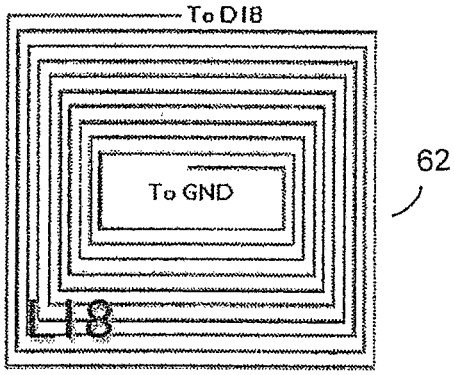
Figure 5C:
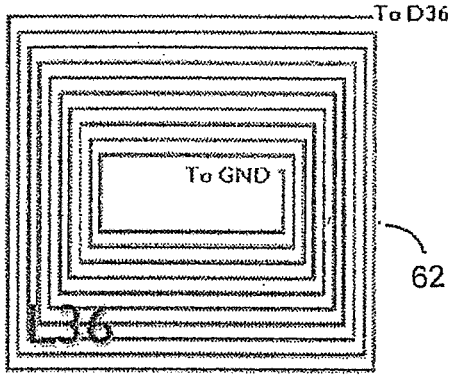

FIG. 2 is a graphical representation of the display panel 100, according to some embodiments of the present invention. As seen in FIG. 2, the display panel 100 has a display area 40 and a plurality of pixels 10 arranged in a two-dimensional array of pixel rows and pixel columns in the display area 40. The display panel 100 also has one or more gate drivers 50 configured to provide signals indicative of scanning timing data to the pixels 10. According to some embodiments of the present invention, the pixels 10 in the display area are arranged in a plurality of pixel groups 90 (see FIG. 4A). As seen in FIG. 3, the display panel 100 has a plurality of antenna units 60 arranged in a two-dimensional antenna array of rows and columns in the display area 40 in relationship to the pixel rows and pixel columns. Each of the antenna units 60 is configured to provide electronic signals indicative of display data to a different pixel group 90. As seen in FIGS. 4 and 4A, each antenna unit 60 has a plurality of antennas 62 arranged in a column, and each pixel group 90 has a plurality of pixel blocks 92 arranged in a column, and each antenna 62 is disposed in relationship to a different pixel block 92. Each of the antennas 62 in the antenna unit 60 is electrically connected to a different data line Dm in the pixel group 90 and configured to provide the electronic signals to the pixels connected to the respective data line. Each antenna 62 is associated with a plurality of gate lines Gn, which are electrically connected to one of the gate drivers 50 as shown in FIG. 3. As seen in FIG. 4, each antenna unit 60 and the associated pixel group 90 have a plurality of data lines Dm, and each antenna 62 is electrically connected to a different data line Dm. As the data lines Dm associated with the antenna unit 60 are spaced from each other, each of the antennas 62 is patterned differently from the other antennas in the same antenna unit 60, as shown in FIGS. 5A-5C. It should be noted that, in FIG. 4, the gate lines Gm are arranged along the longer dimension (LD) of the display 40 (see FIG. 3). FIG. 4B shows the connections between the antennas 62 and the data lines Dm in four neighboring antenna units 60. For explanation purposes, the four neighboring antenna units are denoted by numerals $\mathbf{60}_1$, $\mathbf{60}_2$, $\mathbf{60}_3$ and $\mathbf{60}_4$. It is understood that these four antenna units are associated with four neighboring pixel groups. As seen in FIG. 4B, in the antenna unit $\mathbf{60}_1$, the connection point where the antenna is connected to data line D1 is near gate line G1; the connection point where the antenna is connected to data line D2 is near gate line G49; and the connection point P1 where the antenna is connected to data line D36 is located in the gap GP between G1728 of antenna unit $\mathbf{60}_1$ and G1 of antenna unit $\mathbf{60}_3$. In the antenna unit $\mathbf{60}_3$, the connection point (P3) where the antenna is connected to data line D36 is near gate line G1 and in the gap GP; the connection point where the antenna is connected to data line D35 is near gate line G49; and the connection point where the antenna is connected to data line D1 is near gate line G1728. The connections between antennas and data lines in antenna units $\mathbf{60}_2$ and $\mathbf{60}_4$ are the mirror image of the connections between antennas and data lines in antenna units $\mathbf{60}_1$ and $\mathbf{60}_3$. It should be noted that although the connection points P1 and P3 are located in the same gap GP, they are associated with two different pixel groups. P1 and P3 must be separated. In order to reduce the visual difference (also known as block mura) between neighboring pixel groups such as the pixel groups associated with antenna units ($\mathbf{60}_1$, $\mathbf{60}_2$, $\mathbf{60}_3$, $\mathbf{60}_4$), the separation between P1 and P3 should be smaller than the pitch of one pixel. This rule applies to the gap between any two neighboring antenna units in the same column. As such, the signal difference between neighboring pixel groups and the block mura can be minimized.

According to one embodiment of the present invention, the connection points of data line and antenna are randomly arranged instead of being orderly arranged. However, the separation between the data lines in the gap between any two neighboring antenna units in the same column is kept to a minimum in order to reduce the block mura as discussed above.

As seen in FIGS. 5A-5C, each of the antennas L1, . . . L18, . . . to L36 has a first end connected to a data line Dm and a second end connected to ground. In FIGS. 5A and 5C, the antenna (L1) is the first antenna and the antenna (L36) is the last antenna in the antenna unit 60 (see FIG. 4). The first end of antenna (L1) is connected the data line D1 and the first end of antenna (L36) is connected to the data line D36. Likewise, the first end of antenna (L18) is connected to the data line D18 (not shown). Thus, the first end of an antenna is positioned differently dependent upon the position of the data line to which it is connected.

Figure 6:
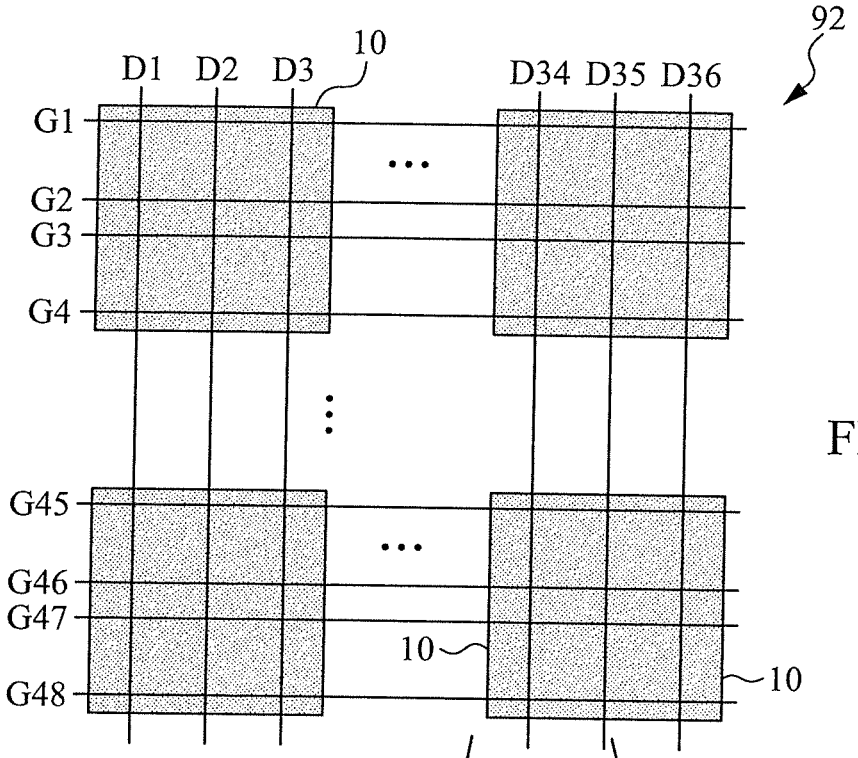
FIG. 6 illustrates a pixel block having a plurality of pixels, according to some embodiments the present invention.
Figure 6A:
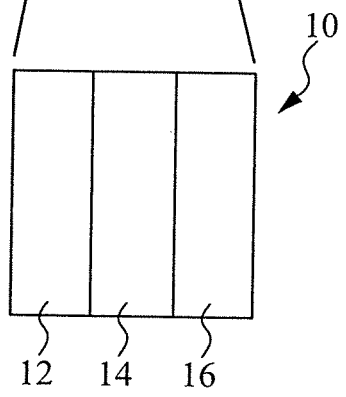
FIG. 6A illustrate a pixel having a plurality of color sub-pixels, according to some embodiments of the present invention.

According to some embodiments of the present invention, there are 36 data lines to convey display data to the pixels 10 in a pixel group 90. As seen in FIGS. 6 and 6A, each pixel block 92 comprises a plurality of pixels 10 and each pixel 10 comprises a plurality of color sub-pixels 12, 14 and 16. For example, the color sub-pixels can be R, G, B sub-pixels. The color sub-pixels in a pixel block 92 (and hence in a pixel group 90) are arranged in a plurality of sub-pixel columns in a sequential manner such that each of the data lines Dm is configured to provide the display data to two adjacent sub-pixel columns. According to some embodiments of the present invention, a pixel row in the pixel group 90 (or pixel block 92 as shown in FIG. 6) has 24 pixels or 72 sub-pixels. Since two adjacent sub-pixel columns share a data line, there are 36 data lines D1-D36 in a pixel group 90 (or pixel block 92). Since each data line Dm in the pixel group 90 is electrically connected to a different antenna 62 (see FIG. 4), the antenna unit 60 has 36 antennas 62. Since each of the antennas 62 in the antenna unit 60 is associated with a different pixel block 92 in the pixel group 90 (see FIG. 4), there are 36 pixel blocks in a pixel group 90.

Figure 6B:
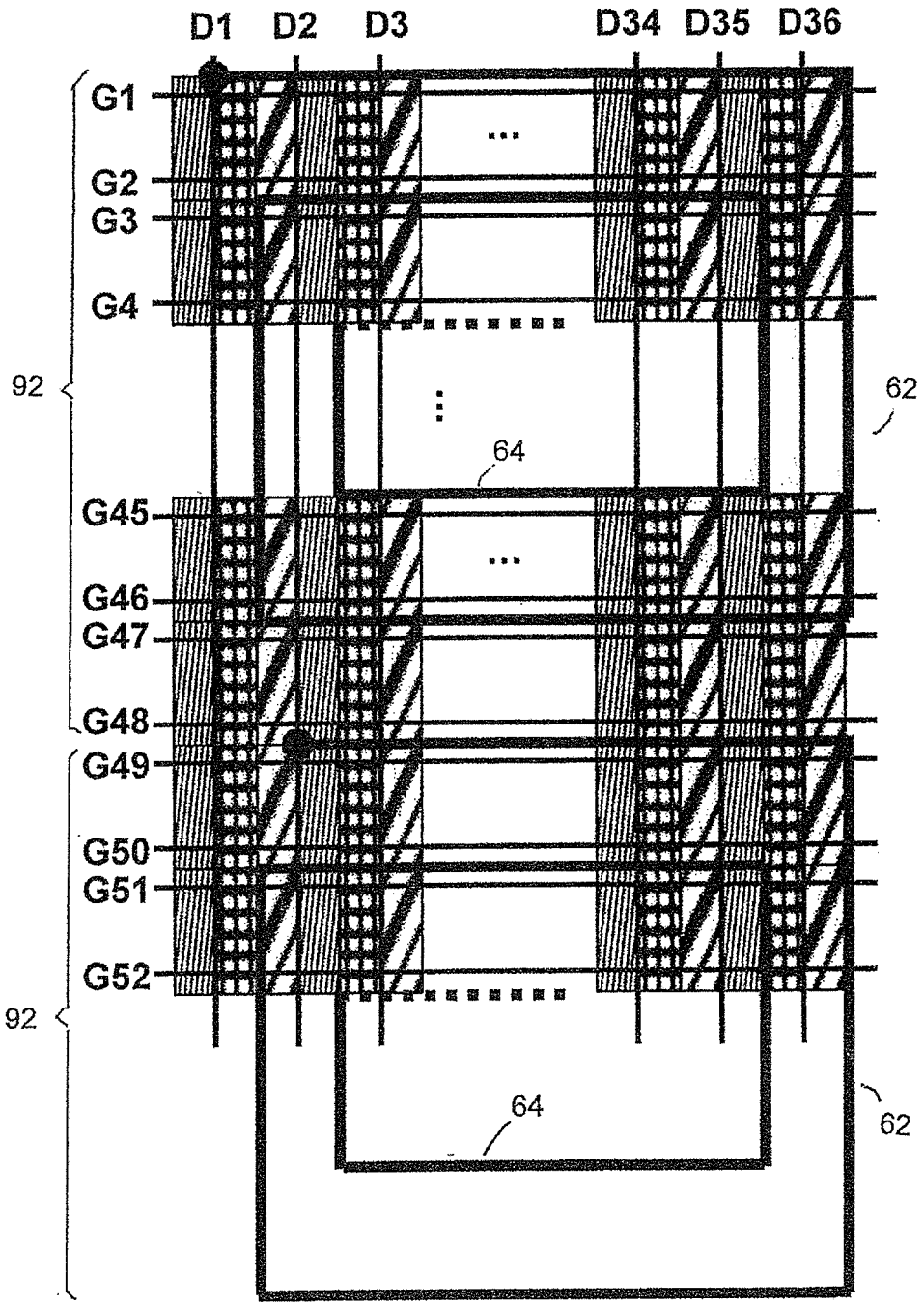
FIG. 6B illustrate an antenna having an antenna coil arranged in a pixel block.
Figure 7:
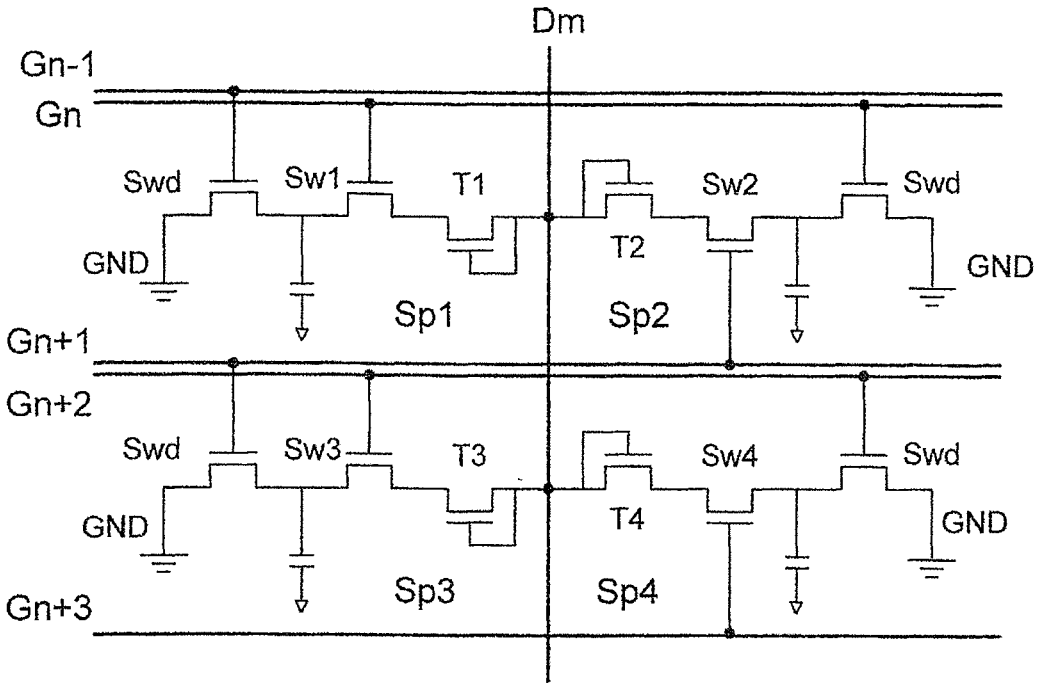
FIG. 7 illustrates the electronic components in two adjacent color sub-pixels sharing one data line and two gate lines.

According to some embodiments of the present invention, the gate lines Gn associated with an antenna 62 and the associated pixel block 92 are arranged in pairs such that each pair of gate lines is configured to provide the scanning timing data to a different pixel row in the pixel block 92 (see FIGS. 6, 6B and 7). According to some embodiments of the present invention, a pixel block 92 has 24 pixel rows. With two gate lines associated with a pixel row, there are 48 gate lines G1-G48 associated with a pixel block 92 as shown in FIG. 6. With 36 antennas in the antenna unit 60 associated with 36 pixel blocks in the pixel group 90, there are 48×36 or 1728 gate lines G1-G1728 associated with an antenna unit 60. Thus, each antenna unit 60 is associated with 62208 color sub-pixels (864 rows of 72 sub-pixels each).

FIG. 6B shows how an antenna 62 is arranged or patterned in the associated pixel block 92. As seen in FIG. 6B, the antenna 62 has a coil 64 with adjoining coil segments. The coil 64 has a substantially rectangular shape such that some coil segments of the coil 64 are parallel to the gate lines Gn and some coil segments are parallel to the data lines Dm such that each of the coil segments is either arranged in the space between two adjacent data line or the space between two adjacent gate lines. The coil segments that are parallel to the data lines do not overlap with any of the data lines and the coil segments that are parallel to the gate lines do not overlap with any of the gate lines. As such, the parasitic capacitance between the antenna coil 64 and the data lines and between the antenna coil 64 and the gate lines can be minimized.

Figure 19:
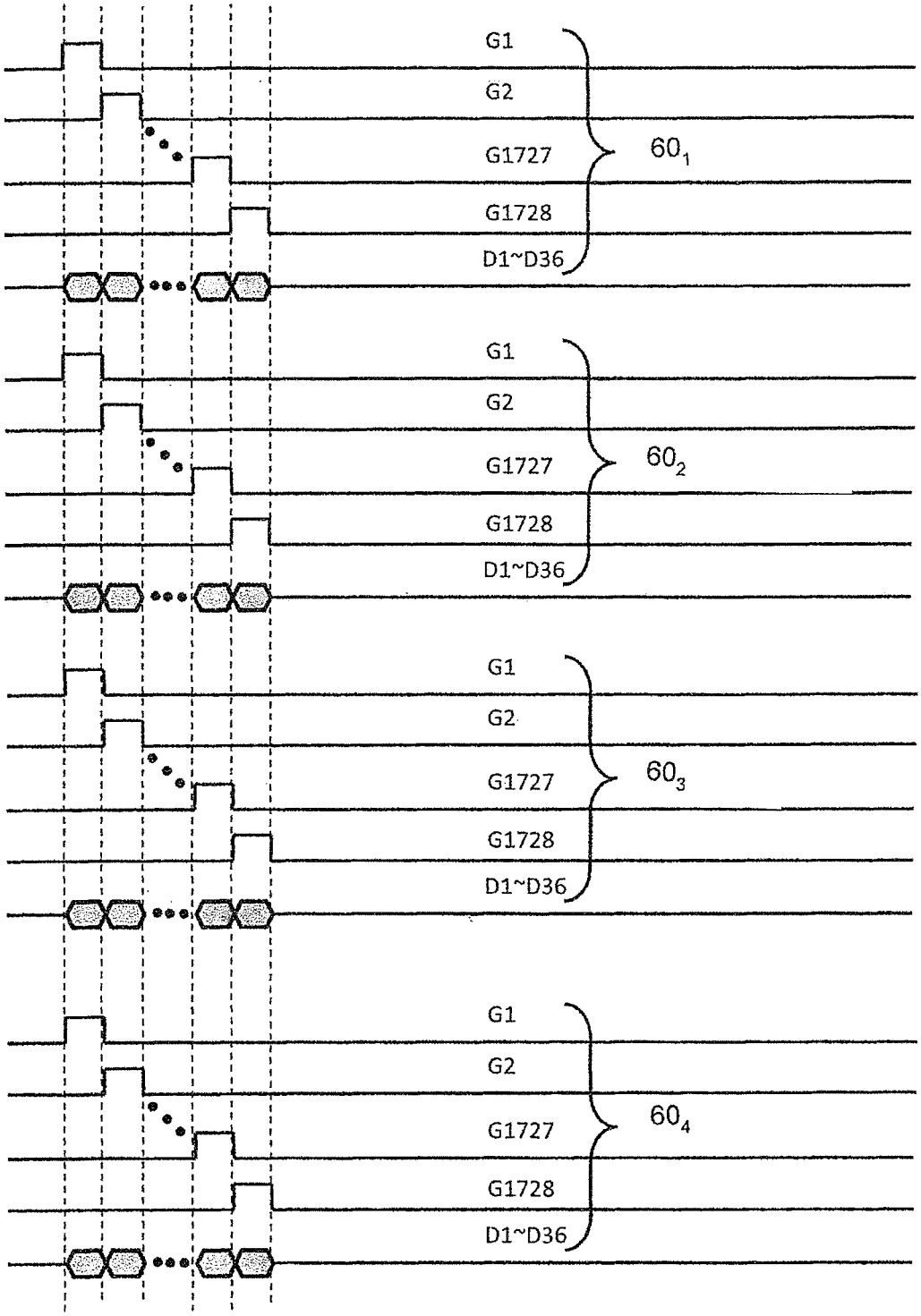
FIG. 19 is a waveform chart showing the timing signals on a group of gate lines in four antenna units.

FIG. 7 illustrates an exemplary electronic circuit in two adjacent color sub-pixels. As shown, the electronic elements or components in the adjacent color sub-pixels have one data line Dm and two gate lines Gn−1, Gn. Each color sub-pixel comprises a plurality of switching elements and a storage capacitor. As shown in FIG. 7, subpixel Sp1 and subpixel Sp2 are in the same row and receive the data signals from the same data line through transistors T1 and T2, which serve as rectifiers. However, the charging switching element Sw1 is connected to the gate line Gn while the charging switching element Sw2 is connected to Gn+1. Because the timing signals on Gn are one time period ahead of the timing signals on Gn+1 (see FIG. 19), Sw1 is switched on one time period ahead of Sw2. Likewise, Sw3 in Sp3 is switched on one time period ahead of Sw4 in Sp4, but Sw2 is switched on one time period ahead of Sw3. In an antenna unit 60 as shown in FIG. 4, there are 36 data lines D1-D36 and 1728 gate lines G1-G1728. This means that the antenna unit 60 is configured to provide data signals to 72 columns and 864 rows of subpixels. In each column of subpixels, the subpixels are sequentially switched on by the timing signals on every second gate lines, such as Gn, Gn+2, Gn+4, etc. In each row, two gate lines are used for charging, or to switch on the charging switching elements, in the subpixels one after another. As seen in FIG. 7, Sw1, Sw2 in the first row are switched on by the timing signals on gate lines Gn, Gn+1 and Sw3, Sw4 in the second row are switched on by the timing signals on gate lines Gn+2 and Gn+3. Furthermore, each subpixel has a preceding gate line to discharge the charge on the storage capacitor to ground (GND) through a switching element Swd. Gn−1 is used for discharging in subpixel Sp1, Gn is used for discharging in Sp2, and so forth. Thus, in each antenna unit, gate lines G1 and G2 are used to for charging in the first row of pixels, and gate lines G1727 and 1728 are used for charging in the last row. Another gate line G0 (Gn−1 in FIG. 7) is used for discharging in the first row. It should be noted that, in different antenna units, the timing signals on corresponding gate lines are the same. As seen in FIG. 19, the timing signals on any gate line Gn in antenna unit $\mathbf{60}_1$ are also the timing signals on gate line Gn in antenna units $\mathbf{60}_2$, $\mathbf{60}_3$ and $\mathbf{60}_4$, etc.

Figure 8A:
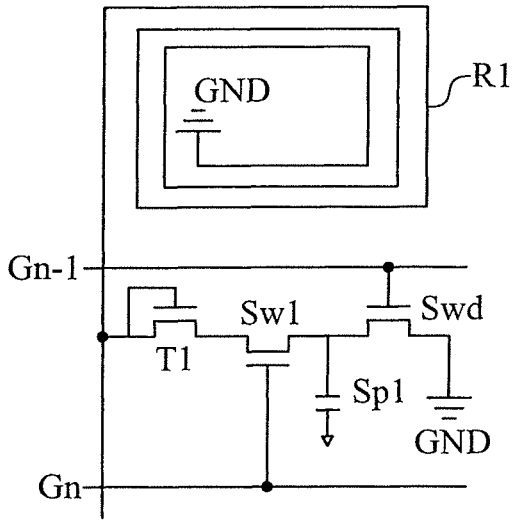
FIGS. 8A and 8B illustrate an inductance element in a color sub-pixel.
Figure 8B:
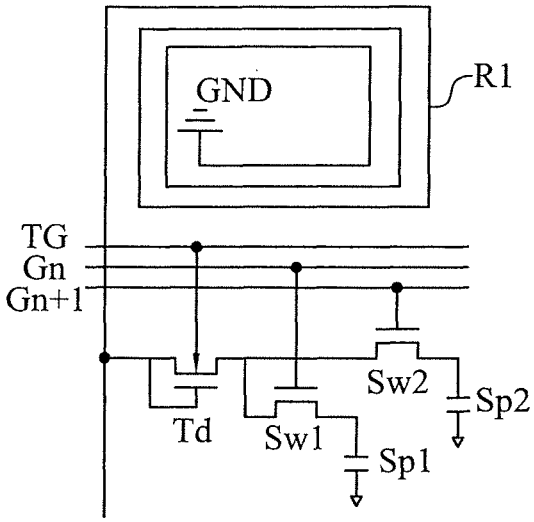
Figure 9:
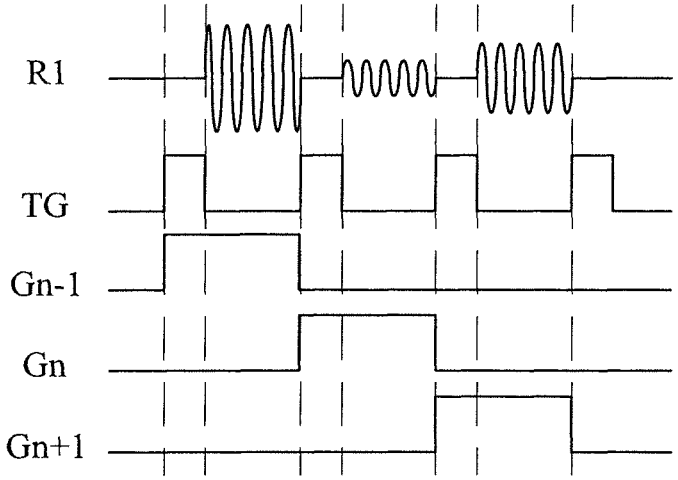
FIG. 9 shows the signals in the inductance element in relationship to the scanning timing.

The layout of the switching elements and storage capacitor in the color sub-pixel Sp1 is shown in FIG. 8A. In order to obtain the display data from the data line Dm which is electrically connected to an antenna 62, each color sub-pixel has an inductance element such as induction coil RI responsive to the frequency signals received by the antenna 62. In a different embodiment, a dual-gate transistor Td and a top gate line TG are used to charge and to discharge the storage capacitors in the sub-pixels as shown in FIG. 8B. The dual-gate transistor Td is operable in a first state as a rectifier and in a second state as a shorted path. The top gate line TG carries a timing signal for causing the dual-gate transistor Td to change from the first state to second state. When the timing signal on TG is low, the dual-gate transistor Td functions as a rectifier to admit a charge to the storage capacitor indicative of the display data from the data line Dm. When the timing signal on TG is high, the dual-gate transistor Td is shorted for resetting the charge on the storage capacitor. As seen in FIG. 8B, Sp1 and Sp2 share a dual-gate transistor Td to save the pixel area. Furthermore, the discharging switching elements Swd in both the sub-pixels are eliminated. FIG. 9 shows the signals in the inductance element in relationship to the scanning timing in the sub-pixel circuit as shown in FIG. 8B.

Figure 16:
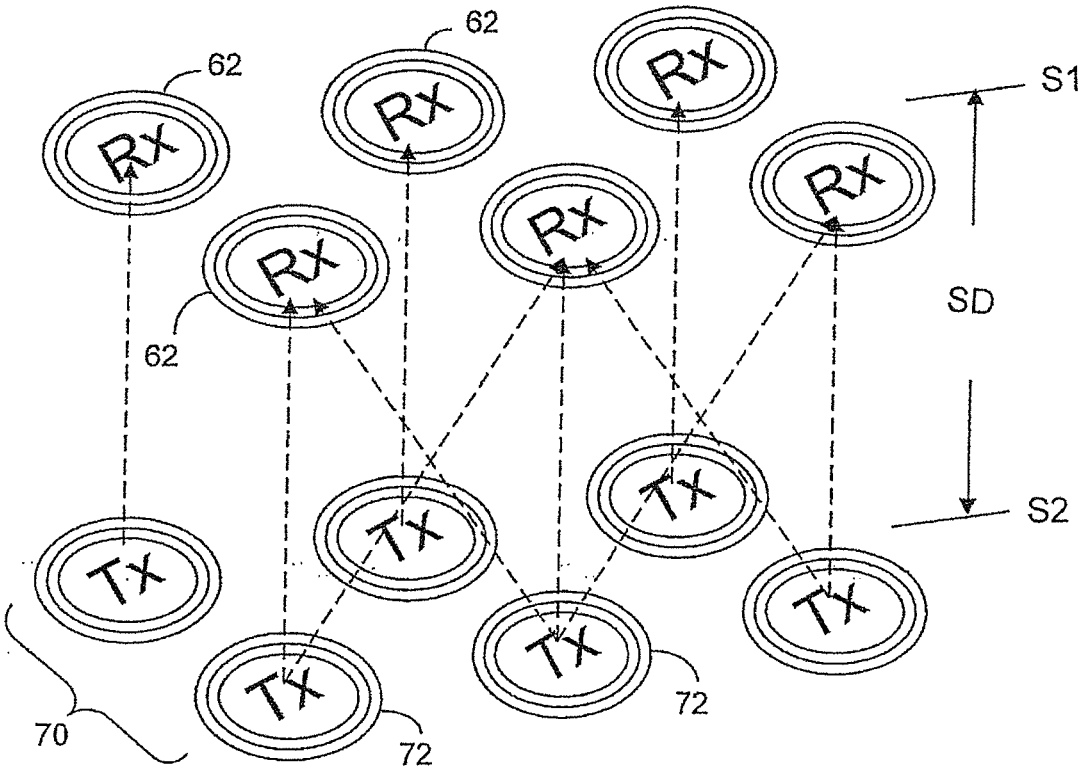
FIG. 16 illustrates possible interferences among the receiving antennas embedded in the electronic layer.

As seen in FIGS. 4 to 8B, the data lines D1-D36 that provide the display data to the pixels and sub-pixels in a pixel group 90 are only connected to the antennas 62 in an antenna unit 60. The electronic signals indicative of the display data provided to the data lines D1-D36 by the antennas 62 are wireless signals received from a wireless signal source 70. The wireless signal source 70, according to embodiments of the present invention, is embedded in the backlight unit 34 (see FIG. 1). The wireless signal source 70 may comprise one or more transmitter circuits 72 as shown in FIG. 16. Thus, the data lines Dm are not required to be connected to any semiconductor drivers. In particular, all the data lines Dm can be disposed entirely in the display area 40.

Figure 10A:
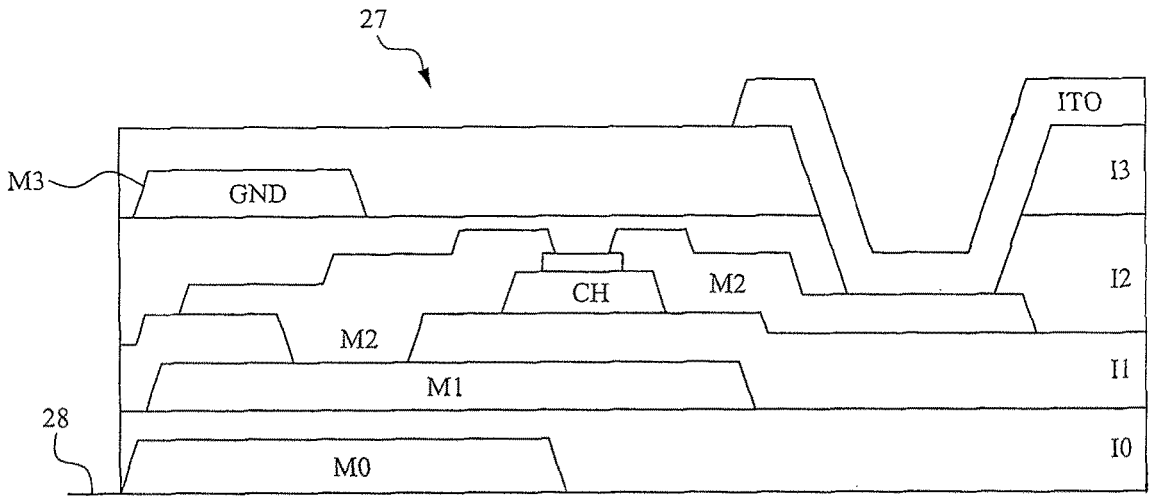
FIGS. 10A and 10B illustrate a section of the electronic layers for forming the electronic components.
Figure 10B:
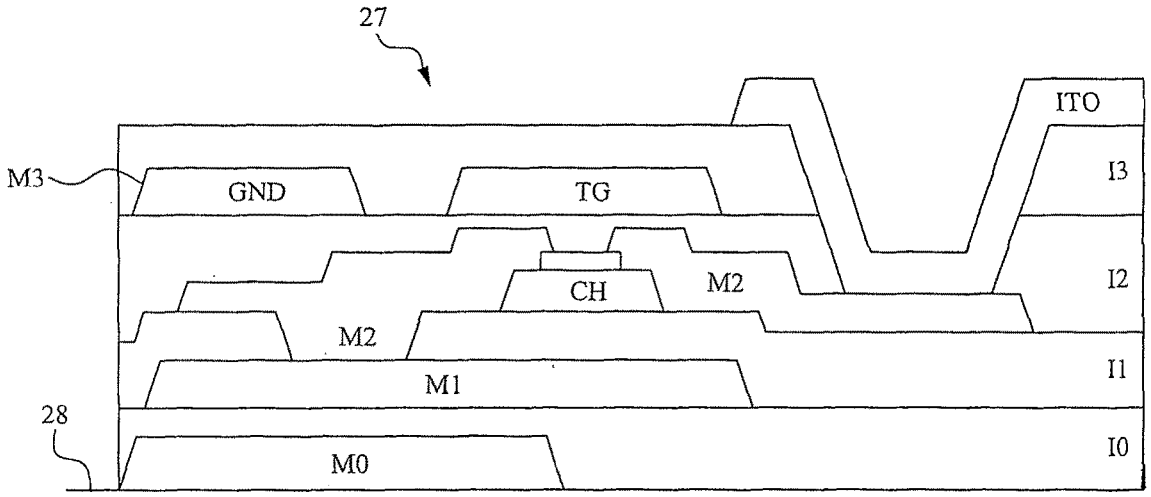

FIGS. 10A and 10B illustrate a section of the electronic layers for forming the electronic elements in a sub-pixel. The electronic layers 27 are disposed on the upper surface of the lower substrate 28 as shown in FIG. 1. As seen in FIGS. 10A and 10B, there are three metal layers M0, M1 and M2 separated by dielectric layers 10, 11, 12 and 14 in the layered structure. In the layered structure, part of M2 is used for forming the data line Dm; M1, along with M2 and M0, is used as part of the storage capacitor; and M0 can be used to form the antenna coil 64 of antenna 62 (see FIG. 6B). M1 is also used to form a gate electrode, which is not shown, in the switching elements. M2 is also used to form the drain/source electrodes of the switching element with a channel CH. The channel CH can be made from amorphous Indium Gallium Zinc Oxide (a-IGZO), for example. An electrically conductor layer such as ITO layer is used for the pixel electrode which is connected to source electrode of the switching element through a via. It should be noted that, in each pixel block 92, only one data line is connected the antenna 62. For example, the antenna coil 64 is electrically connected to data line D1 in the pair of color sub-pixels sharing the gate lines G1 and G2 (see FIG. 6B). In order to electrically connect the antenna 62 to the data line in that pair of color sub-pixels, M0 and M2 can be connected through a via where the M1 layer is not present. It should also be noted that, among the three metal layers, the M0 metal layer is closest to the lower substrate 28 (not shown). In order to minimize the spatial separation distance between the antennas 62 and the wireless signal source 70 embedded in the backlight unit 34 (see FIGS. 1 and 16), M0 is used to form the antennas 62. Another metal layer M3 can be used to form the top gate line (TG) in the layer structure as shown in FIG. 10B and also used to form a ground terminal (GND) in FIGS. 10A and 10B. The ground terminal is connected to the inductance coil RI as shown in FIGS. 8A and 8B and is also used for discharging the storage capacitor as shown in FIGS. 7, 8A and 8B.

Figure 11:
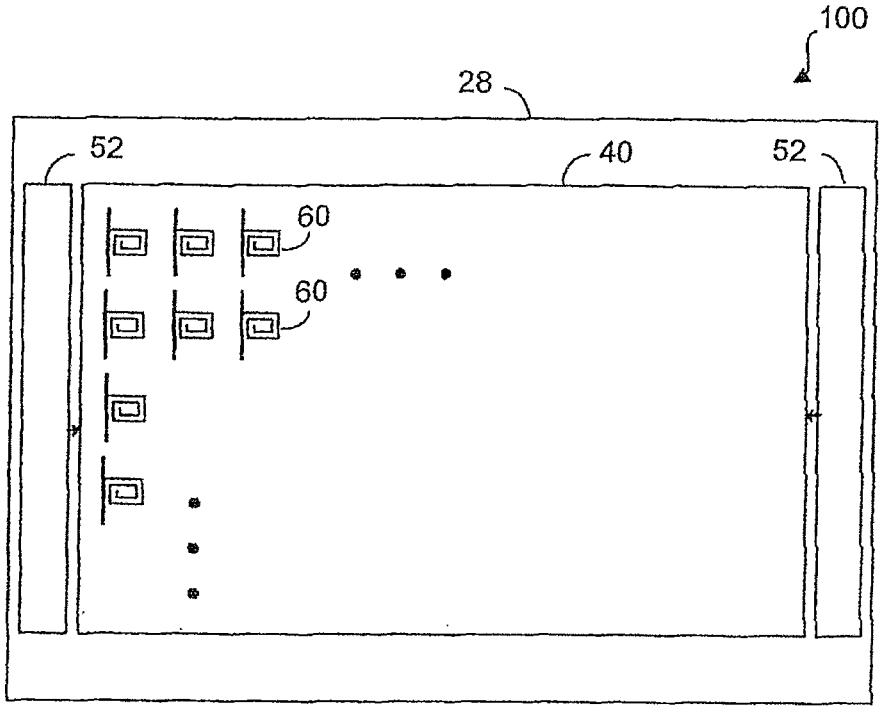
FIG. 11 illustrates a display panel having a gate driver-on-array, according to some embodiments of the present invention.

According to some embodiments of the present invention, the display panel 100 uses a gate driver-on-array to provide the scanning timing data. More specifically, the lower substrate 28 has one or more gate areas 52 and a display area 40 as shown in FIG. 11. The gate areas 52 are used to fabricate gate drivers, each of which is commonly referred to as a gate driver-on-array. The gate lines that provide scanning timing data to the display area are electrically connected to the gate driver-on-array disposed on the gate areas 52.

Figure 12:
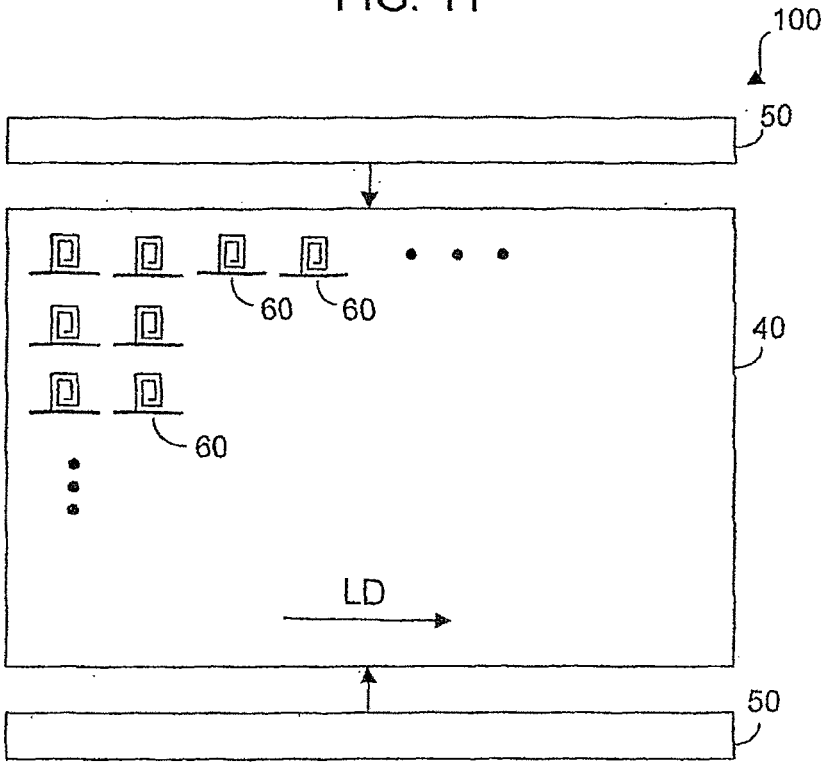
FIG. 12 illustrates a display panel, according to some embodiments of the present invention.
Figure 13:
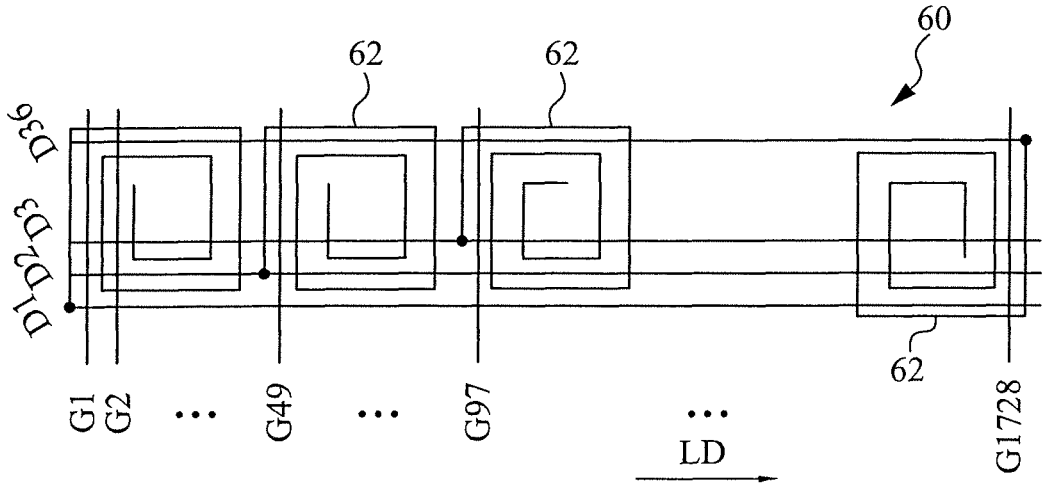
FIG. 13 illustrates an antenna unit associated with the display panel as shown in FIG. 12.
Figure 14:
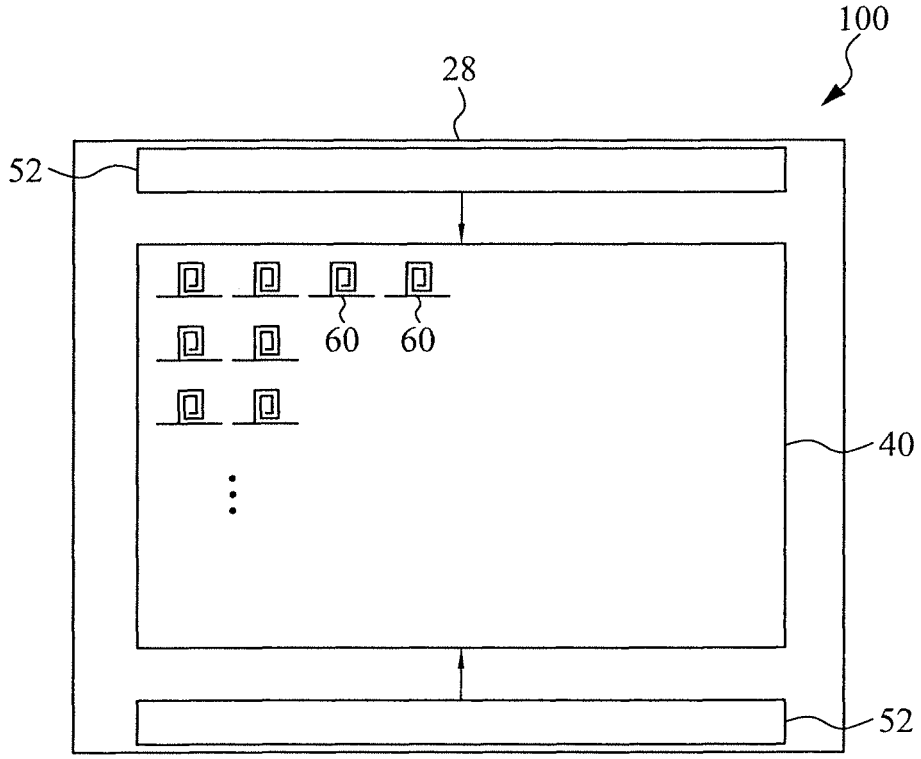
FIG. 14 illustrates a display panel having a gate driver-on-array, according to some embodiments of the present invention.

According to some embodiments of the present invention, the gate lines and the antennas in an antenna unit as shown in FIGS. 12 and 13 are arranged differently from those shown in FIGS. 3 and 4 in order to reduce the amount of gate RC loading. It should be noted that a display panel is usually rectangular, with a longer dimension and a shorter dimension. In FIGS. 3 and 4, the gate lines are arranged along the longer dimension (LD) of the display panel 40. In FIGS. 12 and 13, the gate lines are arranged along the shorter dimension of the display panel 40. Thus, the gate line for each pixel TFT in FIG. 12 is shorter than that in FIG. 3, resulting in smaller gate resistance and parasitic capacitance and higher signal-to-noise ratio. Similar to the gate drivers as shown in FIG. 11, the gate lines can be electrically connected to the gate driver-on-array disposed on the gate areas 52 of the substrate 28 as shown in FIG. 14. In FIGS. 11 and 14, the gate lines are electrically connected to the gate driver-on-array disposed on the gate areas 52 of the substrate 28. In FIGS. 3 and 13, the gate lines are connected to one or more gate drivers that are not fabricated on the substrate 28.

Figure 15A:
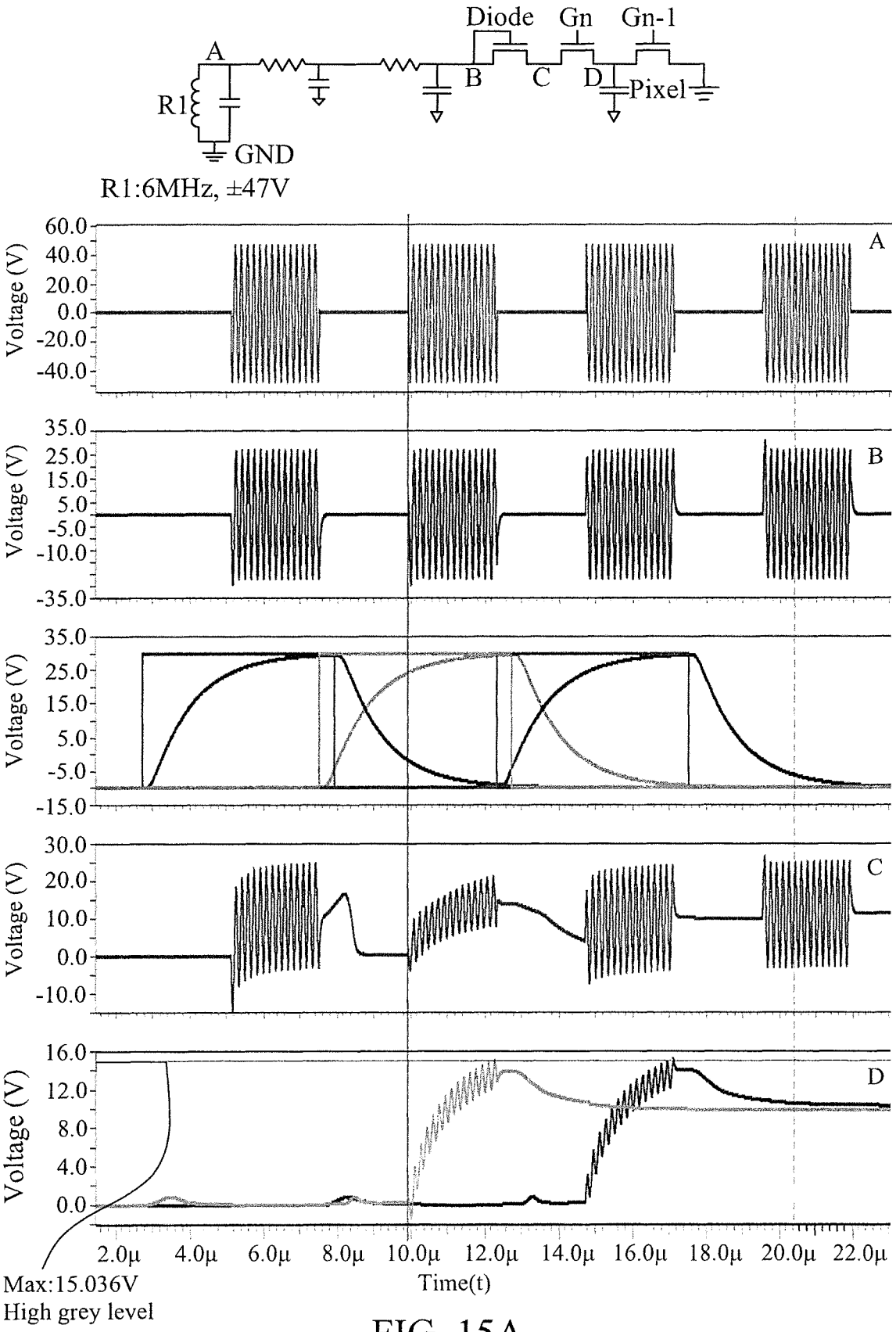
FIGS. 15A-15C illustrate how alternate-current amplitude modulation is used in controlling the grey levels in the color sub-pixels.
Figure 15B:
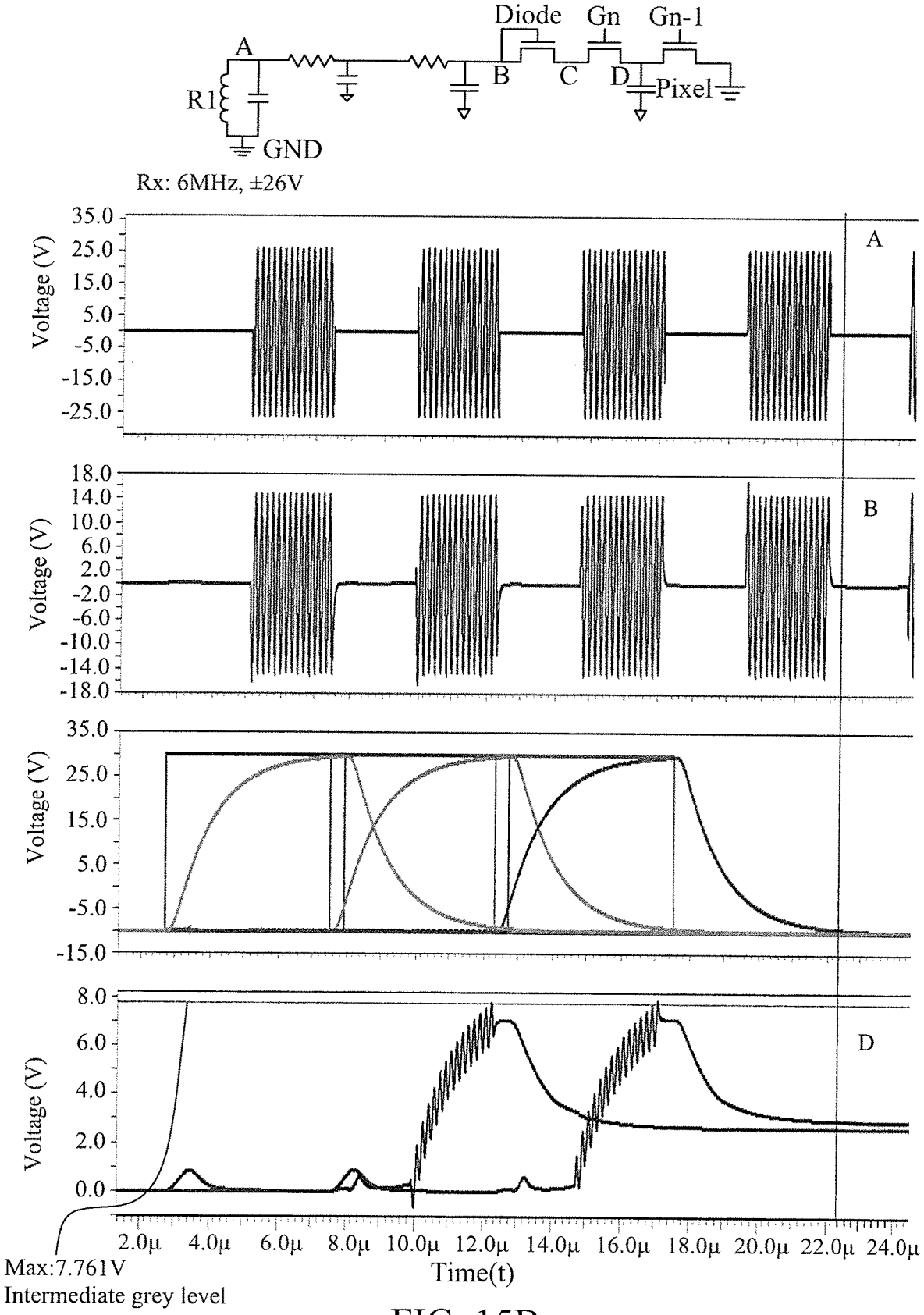
Figure 15C:
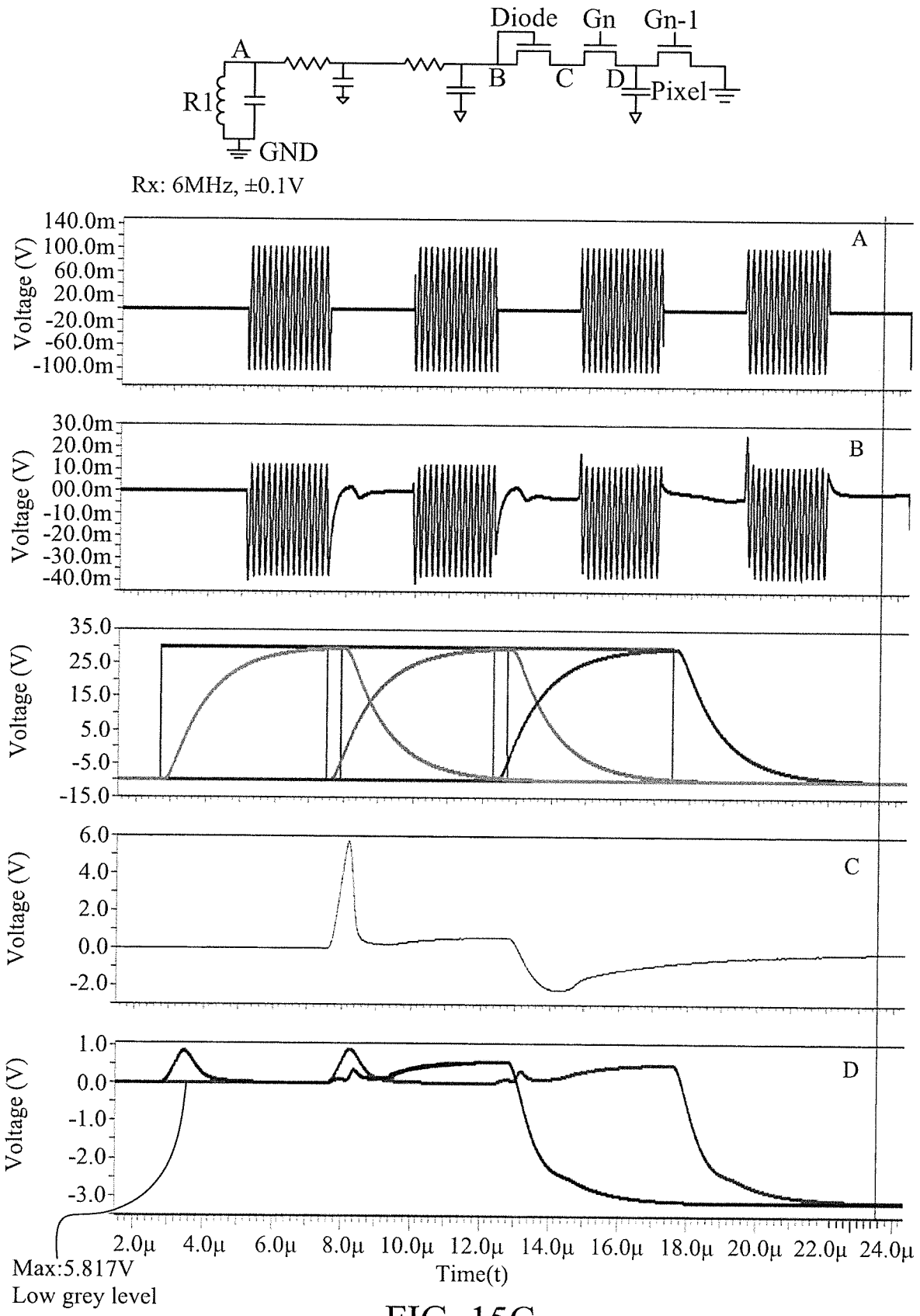

FIGS. 15A-15C illustrate how alternate-current amplitude modulation is used in controlling the grey levels in the color sub-pixels. In each of the timing charts as shown in FIGS. 15A-15C, the signal levels labeled A, B, C and D correspond to various positions on the sub-pixel circuit above the timing charts. In particular, the signal levels at position D are indicative of the grey levels in a display presented by the sub-pixels. FIG. 15A illustrates that a high grey level can be achieved by applying AC signals amplitude modulated by +/−47V. FIG. 15B illustrates an intermediate grey level when the AC signals are amplitude-modulated by +/−26V. FIG. 15C illustrates a low grey level when the AC signals are amplitude-modulated by +/−0.1V.

Figure 17:
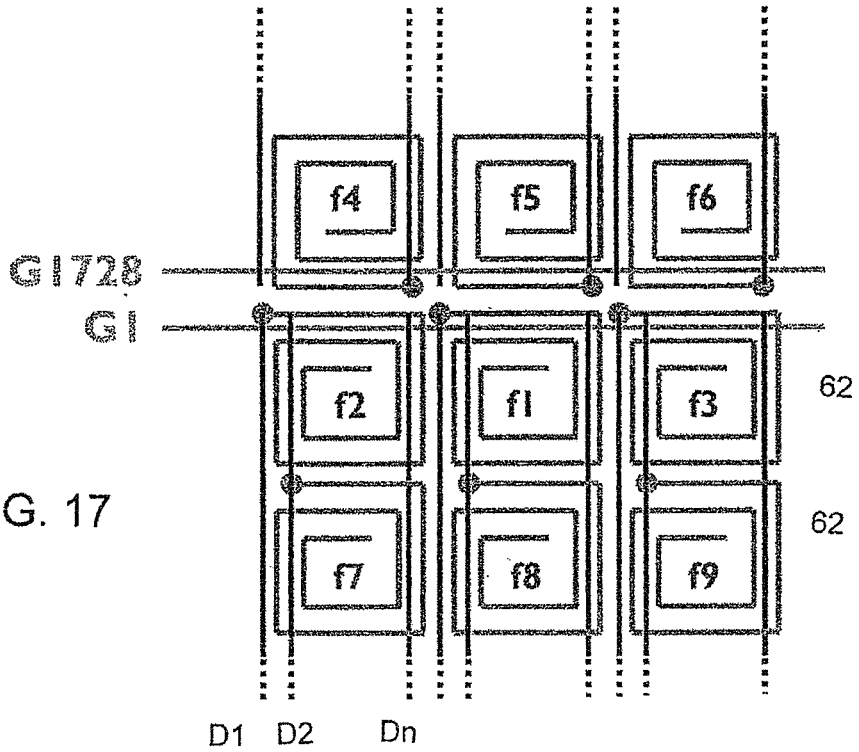
FIG. 17 illustrates how frequency differences are used to prevent signal interference among adjacent antennas.
Figure 18:
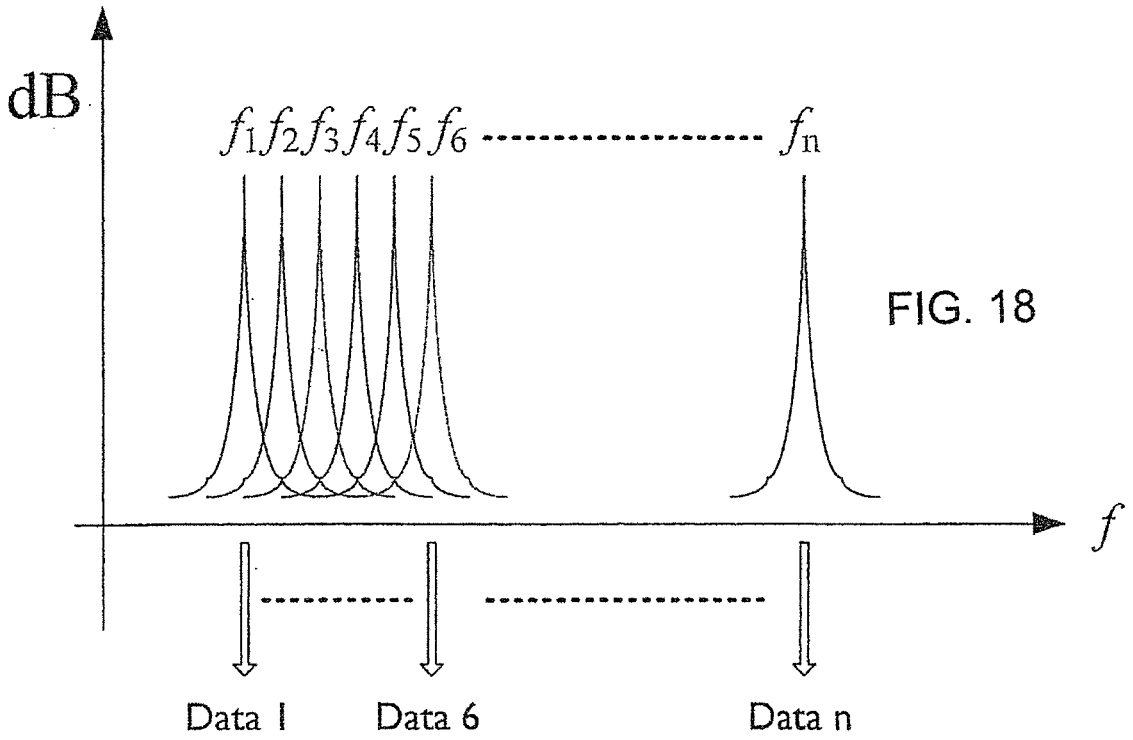
FIG. 18 illustrates an example of frequency signals in relationship to the data lines.

FIG. 16 illustrates how signal interference may occur in the antennas 62. As shown, the transmitter circuits 72 in the wireless signal source 70 are spatially separated from the antennas 62 by a distance SD. According to some embodiments of the present invention, the transmitter circuits 72 are embedded in the backlight unit 34 and the antennas 62 are disposed in the electronic layer 27 which is located on the upper surface of lower substrate 28. In FIG. 16, the upper surface of the lower substrate 28 is denoted as S1 and the backlight unit 34 is denoted as S2. Thus, the transmitter circuits 72 and the antennas 62 are spatially separated by the diffuser or light-guide plate 32, the lower polarizer 30 and the thickness of the lower substrate 28 (see FIG. 1). According to some embodiments of the present invention, the distance between the transmitter circuits 72 and the antennas 62 is about 3.5 mm. With this separation distance, the wireless signals from a transmitter circuit 72 intended for an antenna 62 may be received by other antennas 62 and thus resulting in a type of cross-interference. In order to minimize the effect of cross-interference, the frequency signals received by each antenna are arranged to be different in frequency from the frequency signals received by an adjacent antenna as shown in FIGS. 17 and 18.

In summary, the present invention uses a wireless data driving scheme to provide display data to the pixels in a liquid crystal display panel. In some embodiments of the present invention, antennas embedded in the electronic layers on the lower substrate are used as wireless data receivers, and a plurality of transmitters embedded in the backlight unit are used as the wireless signal source. The present invention also uses a half-source driving (HSD) configuration in order to reduce the number of data lines. By using wireless data transmission, all the data lines can be confined within the display area in the display panel and not connected to semiconductor data drivers. The wireless data driving scheme, according to the present invention, is useful in a large-panel LCD panel where amorphous silicon (a-Si) or Indium Gallium Zinc Oxide (IGZO) transistors are used for switching. However, the wireless data driving scheme can also be used in a display where a different material is used for switching with or without the HSD configuration.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A display panel comprising:

a display area and a plurality of pixels arranged in a two-dimensional array of pixel rows and pixel columns in the display area; and a plurality of antennas configured to provide electronic signals indicative of display data to the pixels, wherein the antennas are configured to receive wireless signals indicative of the display data from a wireless signal source, and the wireless signals comprise frequency signals such that the frequency signals received by each antenna are different in frequency from the frequency signals received by an adjacent antenna, and wherein the plurality of pixels are arranged in a plurality of pixel groups, each pixel group comprising N pixel blocks, and the plurality of antennas are arranged in a plurality of antenna units, each of the antenna units comprising N antennas, each antenna disposed in relationship to a different one of the pixel blocks, and each of the pixel groups further comprises N data lines, each antenna electrically connected to a difference one of the N data lines, wherein N is equal to 36.

2. The display panel according to claim 1, wherein the wireless signals comprise alternate-current amplitude-modulated signals.

3. The display panel according to claim 1, wherein each pixel comprises a plurality of color sub-pixels, and the color sub-pixels in a pixel group are arranged in a plurality of subpixel columns in a sequential manner such that each of the N antennas is configured to provide the display data to two adjacent sub-pixel columns, and wherein the display panel further comprises a plurality of gate lines configured to provide timing signals indicative of scanning timing data to the pixel rows in the pixel group, and the gate lines are arranged in pairs such that each pair of gate lines is configured to provide the scanning timing data to a different pixel row in the pixel group.

4. The display panel according to claim 3, wherein each sub-pixel comprises an inductive element responsive to the electronic signals, the inductive element electrically connected to a data line to provide the display data for the sub-pixel.

5. The display panel according to claim 4, wherein the pair of gate lines comprises a first gate line and a second gate line, and the sub-pixel comprises a storage capacitor, a rectifier, a first switching element and a second switching element electrically connected to the data line in series, wherein the first switching element is configured to receive the display data from the data line through the rectifier, the first switching element further configured to provide a charge to the storage capacitor indicative of the display data in accordance with the timing signals on the first gate line, and the second switching element is configured to remove the charge from the storage capacitor in accordance with the timing signals on the second gate line.

6. The display panel according to claim 3, wherein the two adjacent sub-pixel columns in a pixel row comprises a first sub-pixel, a second sub-pixel, a dual-gate transistor and an inductive element responsive to the electronic signals, the inductive element electrically connected to a data line to provide the display data for the first sub-pixel and the second subpixel through the dual-gate transistor.

7. The display panel according to claim 3, wherein the data lines in each pixel group are arranged in a first direction and the gate lines in each pixel block are arranged in a different second direction, and wherein the antenna comprises an antenna coil having a plurality of adjoining coil segments disposed in a space between two adjacent gate lines or in a space between two adjacent gate lines.

8. The display panel according to claim 3, further comprising:

a substrate, and the pixels comprise switching elements disposed on the substrate; and one or more gate drivers electrically connected to the gate lines for providing the timing signals indicative of scanning timing data, and wherein the gate drivers are disposed on the substrate as a gate driver-on-array.

9. The display panel according to claim 3, further comprising a substrate, and the pixels comprise switching elements disposed on the substrate; and one or more gate drivers electrically connected to the gate lines for providing the timing signals indicative of scanning timing data, wherein the substrate has a shorter dimension and a longer dimension, and wherein the gate lines are arranged along the shorter dimension.

10. The display panel according to claim 3, further comprising a substrate, and the pixels comprise switching elements disposed on the substrate; and one or more gate drivers electrically connected to the gate lines for providing the timing signals indicative of scanning timing data, wherein the substrate has a shorter dimension and a longer dimension, and wherein the gate lines are arranged along the longer dimension.

11. The display panel according to claim 1, wherein each pixel has a pixel pitch determining a height of a pixel row, and wherein each antenna unit is associated with a different pixel group, each pixel group comprising a plurality of data lines connected to the plurality of antennas in the antenna unit, and wherein the plurality of antenna units in an antenna column comprises a first antenna unit and an adjacent second antenna unit, wherein each of the data lines in the pixel group associated with the first antenna unit has a corresponding one of the data lines in the pixel group associated second antenna unit separated by a gap, wherein the gap is smaller than the pixel pitch.

12. The display panel according to claim 1, further comprising a substrate, a plurality of gate lines and one or more gate drivers, wherein the one or more gate drivers is electrically connected to the gate lines for providing timing signals indicative of scanning timing data to the pixels, and the substrate has a shorter dimension and a longer dimension, and wherein the gate lines are arranged along the shorter dimension.

13. The display panel according to claim 1, wherein each of the pixels comprise a first sub-pixel and a second sub-pixel, the first sub-pixel and the second sub-pixel are connected to one of the plurality of antennas through one of data lines to receive the electronic signals indicative of display data, and each of the first sub-pixel and the second sub-pixel comprises a storage capacitor, a rectifier, a first switching element and a second switching element electrically connected to said data line in series, wherein the first switching element is configured to receive the display data from said data line through the rectifier, the first switching element further configured to provide a charge to the storage capacitor indicative of the display data in accordance with timing signals on the first gate line, and the second switching element is configured to remove the charge from the storage capacitor.

14. The display panel according to claim 1, wherein each pixel block comprises a plurality of pixel rows and pixel columns.

15. A display panel comprising: a display area and a plurality of pixels arranged in a two-dimensional array of pixel rows and pixel columns in the display area; and a plurality of antennas configured to provide electronic signals indicative of display data to the pixels, wherein the antennas are configured to receive wireless signals indicative of the display data from a wireless signal source, and the wireless signals comprise frequency signals such that the frequency signals received by each antenna are different in frequency from the frequency signals received by an adjacent antenna, and wherein the plurality of pixels are arranged in a plurality of pixel groups, each pixel group comprising N pixel blocks, and the plurality of antennas are arranged in a plurality of antenna units, each of the antenna units comprising N antennas, each antenna disposed in relationship to a different one of the pixel blocks, and each of the pixel groups further comprises N data lines, each antenna electrically connected to a difference one of the N data lines, with N being a positive integer greater than 2, wherein each pixel comprises a plurality of color sub-pixels, and the color sub-pixels in a pixel group are arranged in a plurality of subpixel columns in a sequential manner such that each of the N antennas is configured to provide the display data to two adjacent sub-pixel columns, and wherein the display panel further comprises a plurality of gate lines configured to provide timing signals indicative of scanning timing data to the pixel rows in the pixel group, and the gate lines are arranged in pairs such that each pair of gate lines is configured to provide the scanning timing data to a different pixel row in the pixel group, wherein the two adjacent sub-pixel columns in a pixel row comprises a first sub-pixel, a second sub-pixel, a dual-gate transistor and an inductive element responsive to the electronic signals, the inductive element electrically connected to a data line to provide the display data for the first sub-pixel and the second sub-pixel through the dual-gate transistor, and wherein the pair of gate lines comprises a first gate line and a second gate line, and wherein the first sub-pixel comprises a first storage capacitor and a first switching element electrically connected to the data line, the first switching element configured to admit a first charge to the first storage capacitor indicative of the display data in accordance with the timing signals from the first gate line, and the second sub-pixel comprises a second storage capacitor and a first switching element electrically connected to the data line, the first switching element configured to admit a first charge to the first storage capacitor indicative of the display data in accordance with the timing signals from the second gate line, wherein the dual-gate transistor is operable in a first state as a rectifier and in a second state as a shorted path, and wherein the pixel row further comprises a third gate line carrying a time signal configured to cause the dual-gate transistor to change from the first state to the second state so as to remove the first charge from the first storage capacitor and to remove the second charge from the second storage capacitor.

16. The display panel according to claim 15, wherein each pixel block comprises a plurality of pixel rows and pixel columns.

17. A display panel comprising:

a display area and a plurality of pixels arranged in a two-dimensional array of pixel rows and pixel columns in the display area; and a plurality of antennas configured to provide electronic signals indicative of display data to the pixels, wherein the antennas are configured to receive wireless signals indicative of the display data from a wireless signal source, and the wireless signals comprise frequency signals such that the frequency signals received by each antenna are different in frequency from the frequency signals received by an adjacent antenna, wherein the pixels comprise switching elements and capacitors, said display panel further comprising:

a substrate, and a plurality of component layers configured to form the switching elements and the capacitors in the pixels, wherein the component layers comprise:

a first electrically conductive layer disposed on part of the substrate, a first insulating layer disposed on the first electrically conductive layer and the substrate, a second electrically conductive layer disposed on part of the first insulating layer, a second insulating layer disposed on the second electrically conductive layer and the first insulating layer, a third electrically conductive layer disposed on part of the second insulating layer and electrically connected to the second electrically conductive layer through a via in the second insulating layer, a third insulating layer disposed on the third electrically conductive layer and the second insulating layer, a fourth electrically conductive layer disposed on part of the third insulating layer, a fourth insulating layer disposed on the fourth electrically conductive layer and the third insulating layer, and a transparent conductive layer disposed on the fourth insulating layer and electrically connected to the third electrically conductive layer through a via in the third and fourth insulating layers, wherein parts of the second electrically conductive layer, the second insulating layer and the third electrically conductive layer are arranged to form the switching elements, and parts of the first, second, third, and fourth electrically conductive layer together with parts of the first, second and third insulating layers are arranged to form the capacitors, and wherein different parts of the first electrically conductive layer are arranged to form the antennas.

18. A method for providing display data to a display panel, comprising:

arranging a plurality of pixels in a two-dimensional array of pixel rows and pixel columns in a display area in the display panel;

arranging a plurality of antennas to provide electronic signals indicative of display data to the pixels, and arranging a wireless signal source in relationship to the display panel for providing wireless signals indicative of the display data to the antennas, the wireless signals comprising alternate-current amplitude-modulated signals, wherein the antennas are configured to receive wireless signals indicative of the display data from a wireless signal source, and the wireless signals comprise frequency signals such that the frequency signals received by each antenna are different in frequency from the frequency signals received by an adjacent antenna, and wherein the plurality of pixels are arranged in a plurality of pixel groups, each pixel group comprising N pixel blocks, and the plurality of antennas are arranged in a plurality of antenna units, each of the antenna units comprising N antennas, each antenna disposed in relationship to a different one of the pixel blocks, and each of the pixel groups further comprises N data lines, each antenna electrically connected to a difference one of the N data lines, wherein N is equal to 36.

19. The method according to claim 18, wherein each pixel block comprises a plurality of pixel rows and pixel columns.

* * * * *